US005832758A

United States Patent [19]

White

[11] Patent Number: 5,832,758

[45] Date of Patent: Nov. 10, 1998

[54] LOCKING MECHANISM

[75] Inventor: David A. White, Keston Park, England

[73] Assignee: Vacant Property Security Limited, United Kingdom

[21] Appl. No.: 603,327

[22] Filed: Feb. 20, 1996

[30] Foreign Application Priority Data

| | | | |
|---|---|---|---|
| Feb. 22, 1995 | [GB] | United Kingdom | 9503448 |
| Feb. 22, 1995 | [GB] | United Kingdom | 9503449 |
| Feb. 22, 1995 | [GB] | United Kingdom | 9503459 |
| Feb. 22, 1995 | [GB] | United Kingdom | 9503460 |
| Feb. 22, 1995 | [GB] | United Kingdom | 9503520 |

[51] Int. Cl.[6] ..... E05B 13/00

[52] U.S. Cl. ..... 70/218; 70/467; 70/422; 70/DIG. 42; 292/DIG. 62

[58] Field of Search ..... 70/422, DIG. 42, 70/218, 467; 292/DIG. 62, DIG. 27

[56] References Cited

U.S. PATENT DOCUMENTS

| | | | |
|---|---|---|---|
| 2,063,708 | 12/1936 | Swilens | 70/422 |
| 2,787,154 | 4/1957 | Wesberry | 70/422 |
| 3,431,754 | 3/1969 | Brumelle | 70/144 |
| 4,191,438 | 3/1980 | Day | 312/306 |
| 4,457,148 | 7/1984 | Johansson et al. | 70/278 |
| 4,478,444 | 10/1984 | Kurz et al. | 292/333 |
| 4,534,192 | 8/1985 | Harshburger et al. | 70/DIG. 42 X |

FOREIGN PATENT DOCUMENTS

| | | | |
|---|---|---|---|
| 111285 | 7/1968 | Denmark | 292/150 |
| 0141623 | 5/1985 | European Pat. Off. . | |
| 0365394 | 4/1990 | European Pat. Off. . | |
| 0633372A1 | 1/1995 | European Pat. Off. . | |
| 533212 | 9/1931 | Germany | 292/333 |
| 4013440A1 | 10/1991 | Germany . | |
| 9110751 U | 2/1993 | Germany . | |
| 380770 | 6/1940 | Italy | 292/333 |
| 234611 | 6/1925 | United Kingdom . | |
| 384575 | 12/1932 | United Kingdom . | |
| 389229 | 3/1933 | United Kingdom | 292/150 |
| 462445 | 3/1937 | United Kingdom . | |
| 626578 | 7/1949 | United Kingdom . | |
| 722819 | 2/1955 | United Kingdom . | |
| 889934 | 2/1962 | United Kingdom . | |
| 1109817 | 4/1968 | United Kingdom . | |
| 2119013 | 11/1983 | United Kingdom . | |
| 2134170 | 8/1984 | United Kingdom . | |
| 2136045 | 9/1984 | United Kingdom . | |
| 2143574 | 2/1985 | United Kingdom . | |
| 2147343 | 5/1985 | United Kingdom . | |
| 2218461 | 11/1989 | United Kingdom . | |
| 2247042 | 2/1992 | United Kingdom . | |
| 2275734 | 9/1994 | United Kingdom . | |
| 2280474 | 2/1995 | United Kingdom . | |

*Primary Examiner*—Lloyd A. Gall
*Attorney, Agent, or Firm*—Mason, Kolehmainen, Rathburn & Wyss

[57] ABSTRACT

A locking mechanism for security door assemblies, in particular but not exclusively, to a security door assembly which is fitted temporarily on a building. The locking mechanism for such a security door comprises a locking member movable between a locking state and non-locking state. A lock releasably engagable with the locking member prevents the locking member moving to the non-locking state. The lock mechanism further includes an operating device that is coupled to the locking member by a connecting structure which includes a force limiter. The force limiter limits the force the operating device can apply to the locking member without damage to any of the parts of the locking mechanism.

12 Claims, 20 Drawing Sheets

Fig. 3
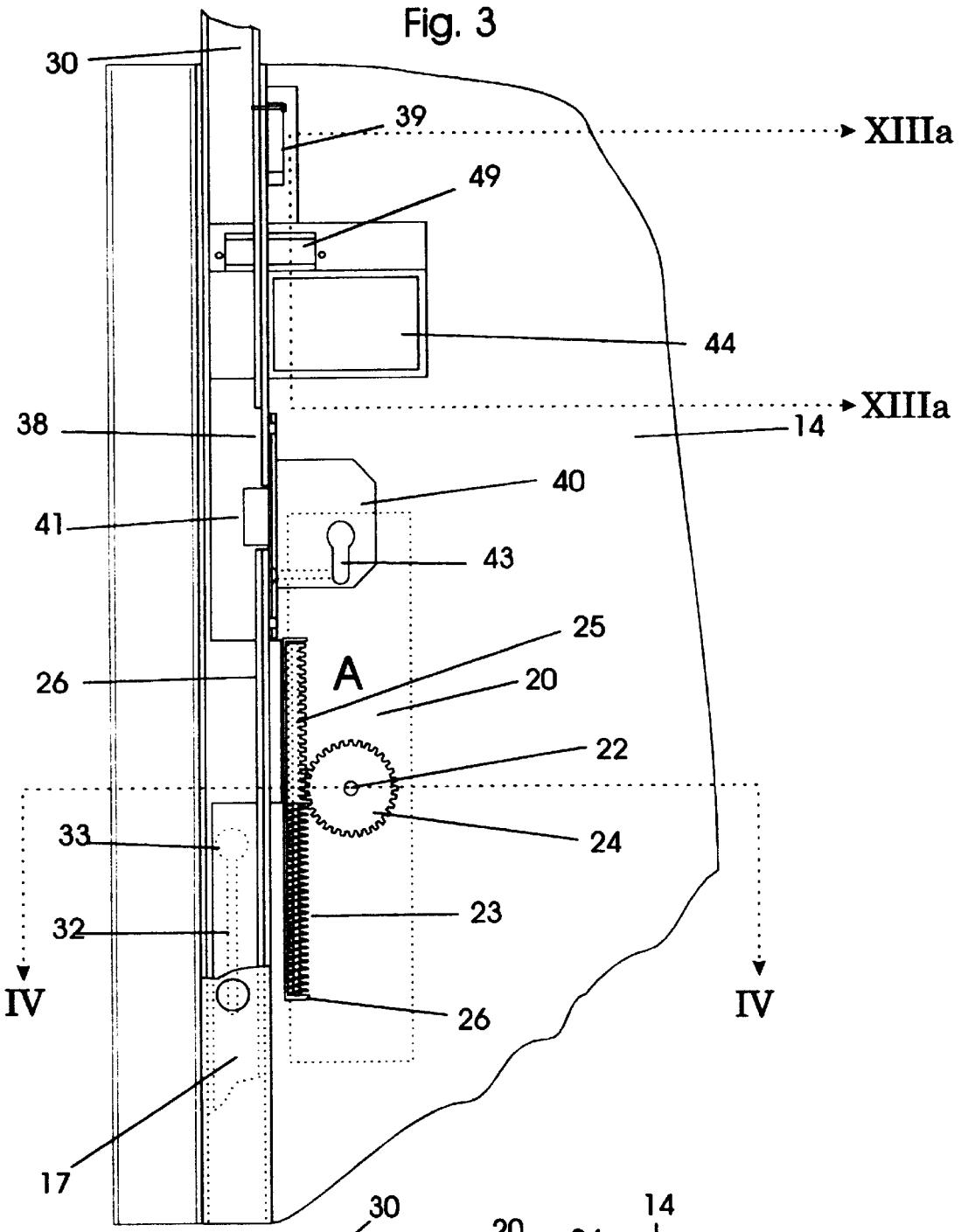
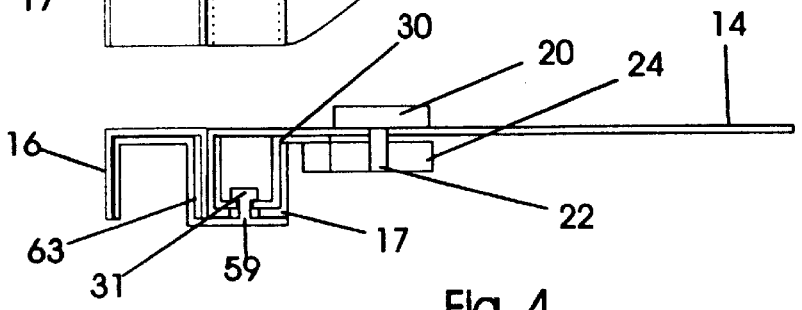
Fig. 4

Fig. 5
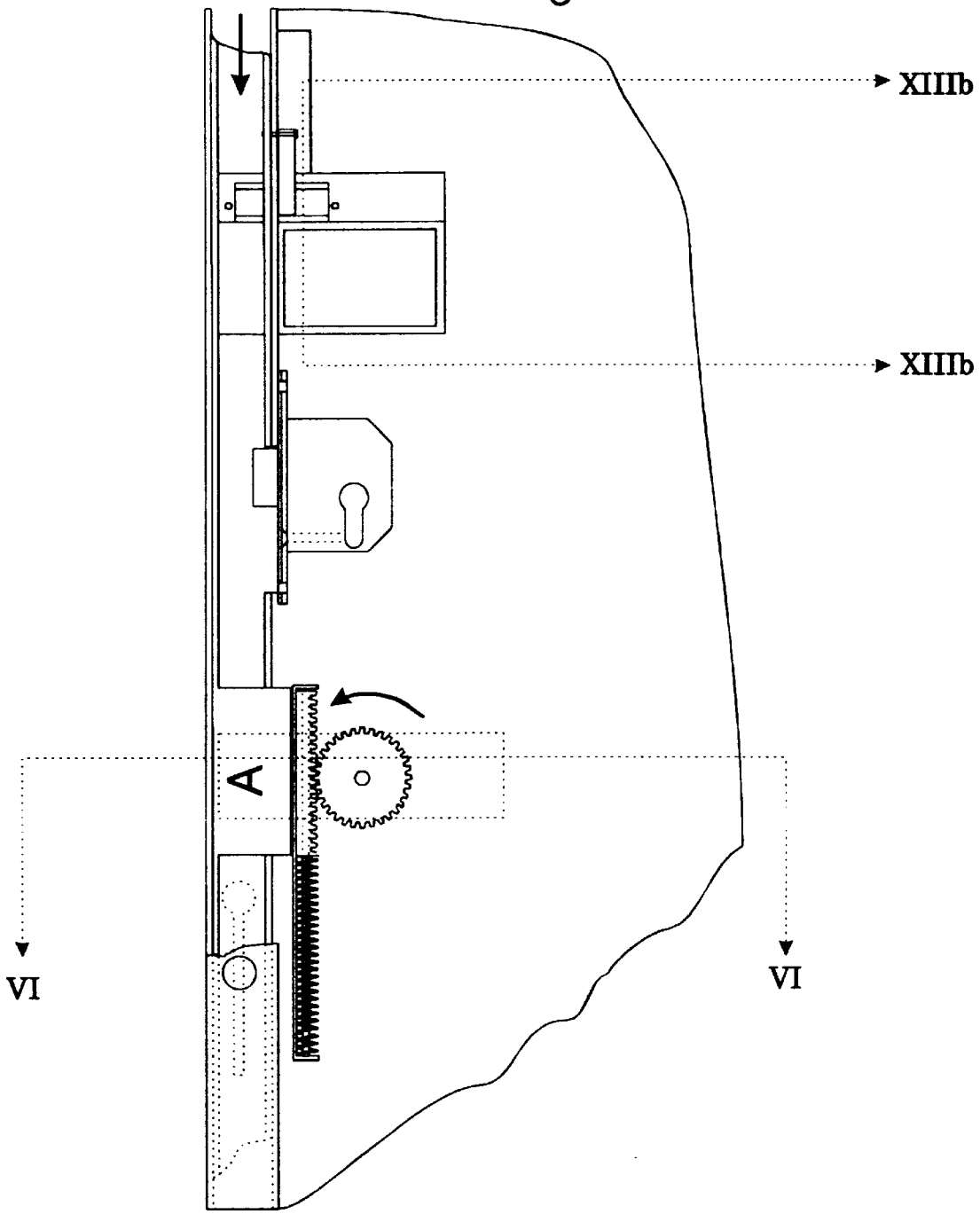
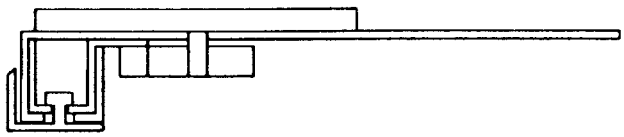
Fig. 6

Fig. 7
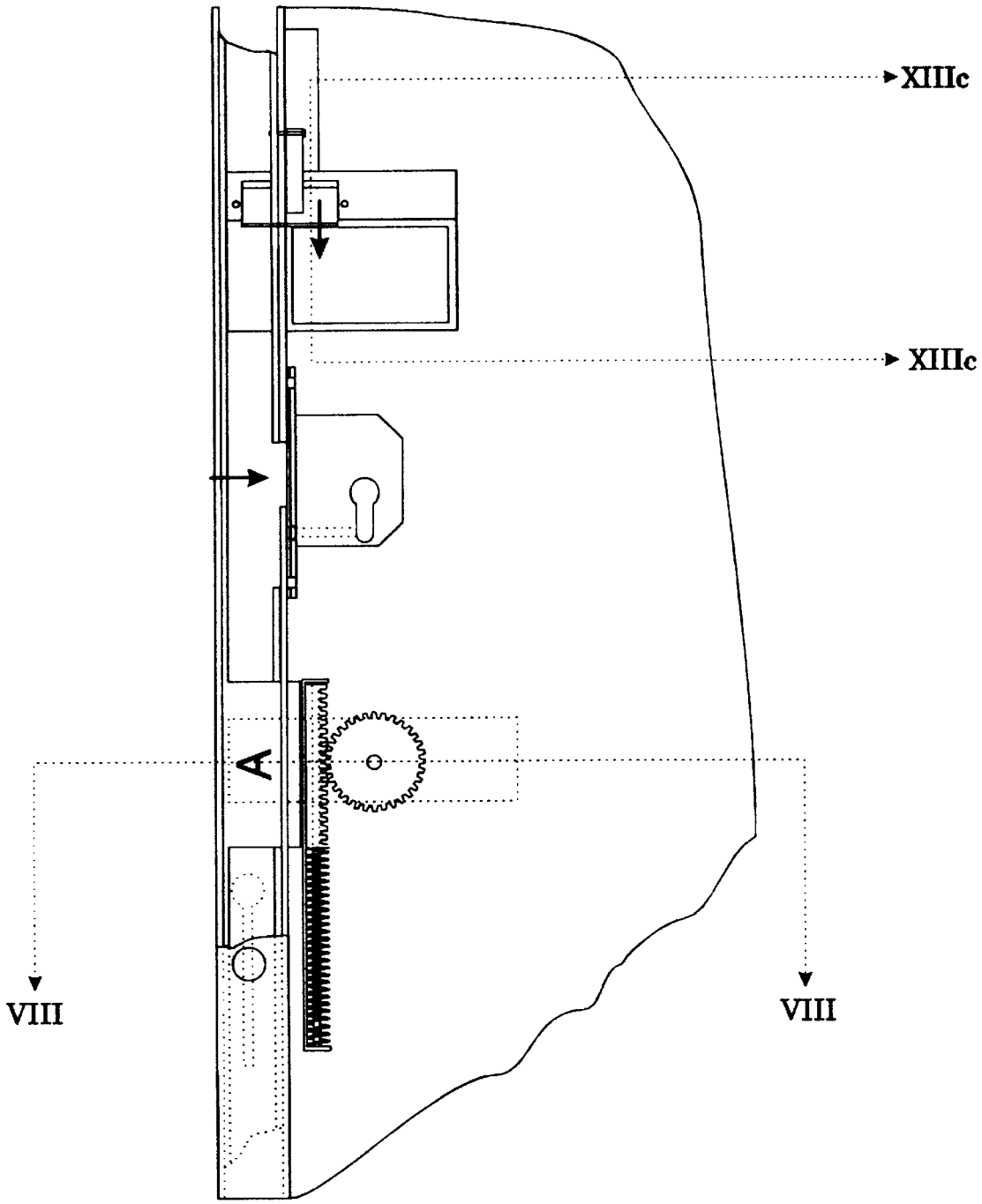
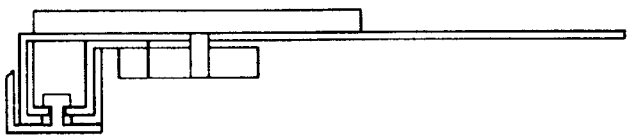
Fig. 8

Fig. 11
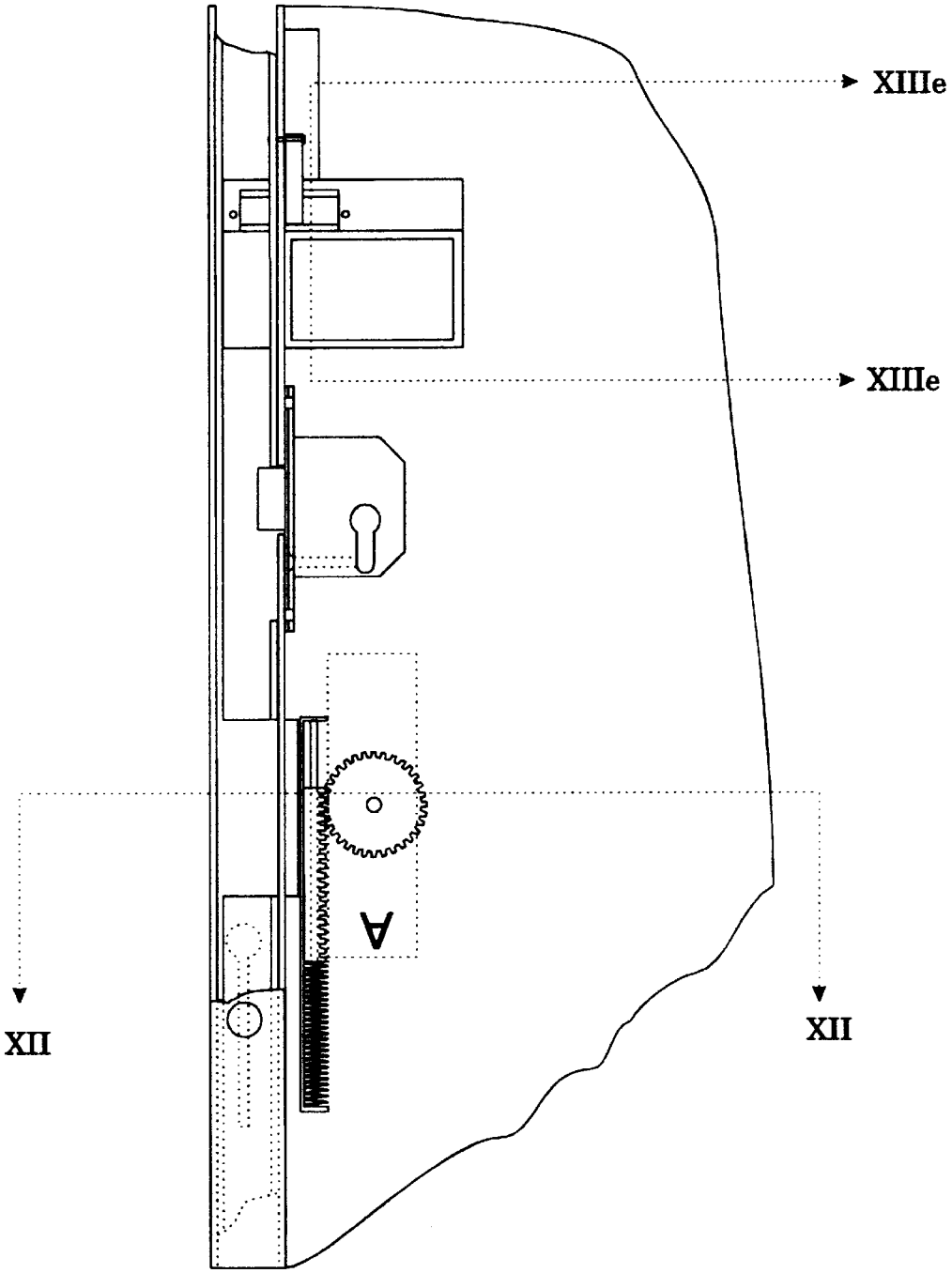
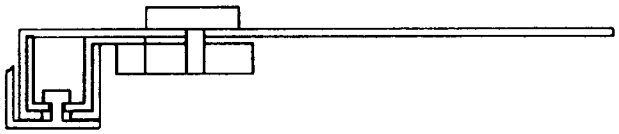
Fig. 12

Fig.14
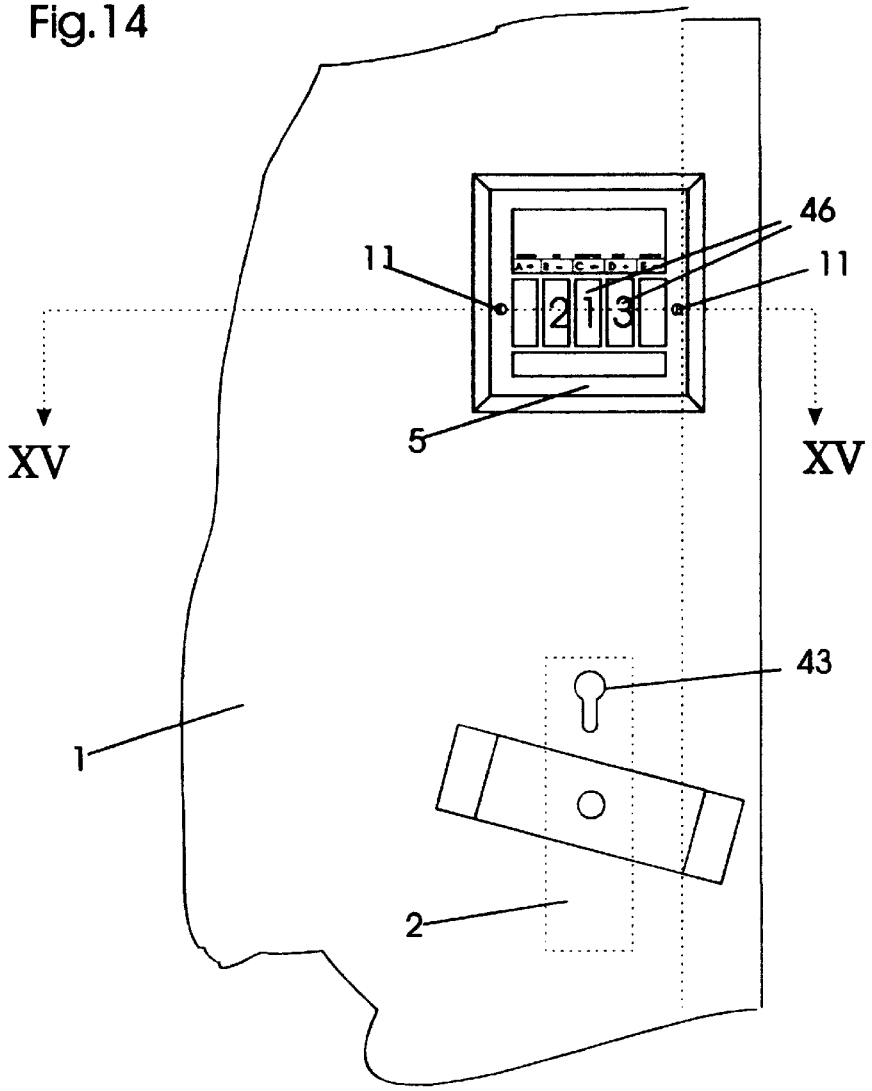
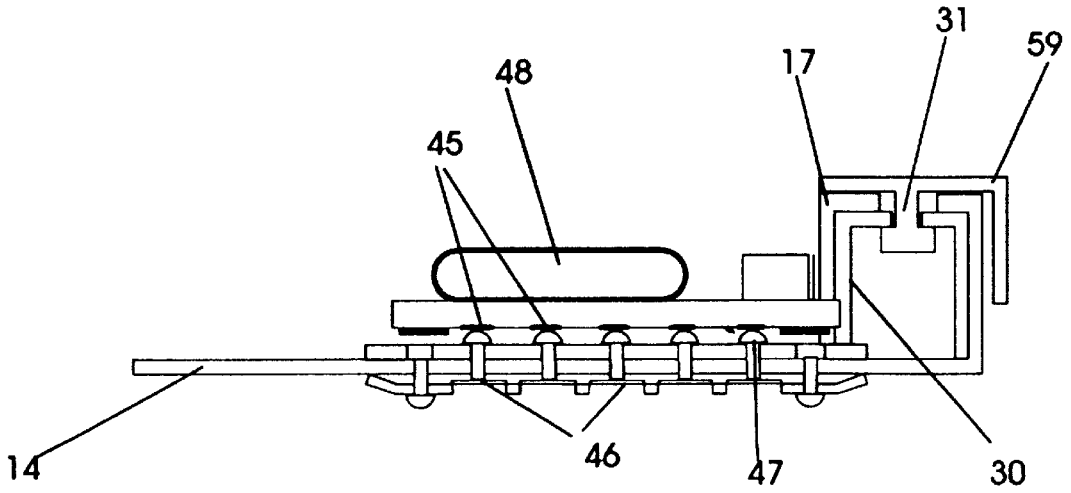
Fig.15

Fig. 17
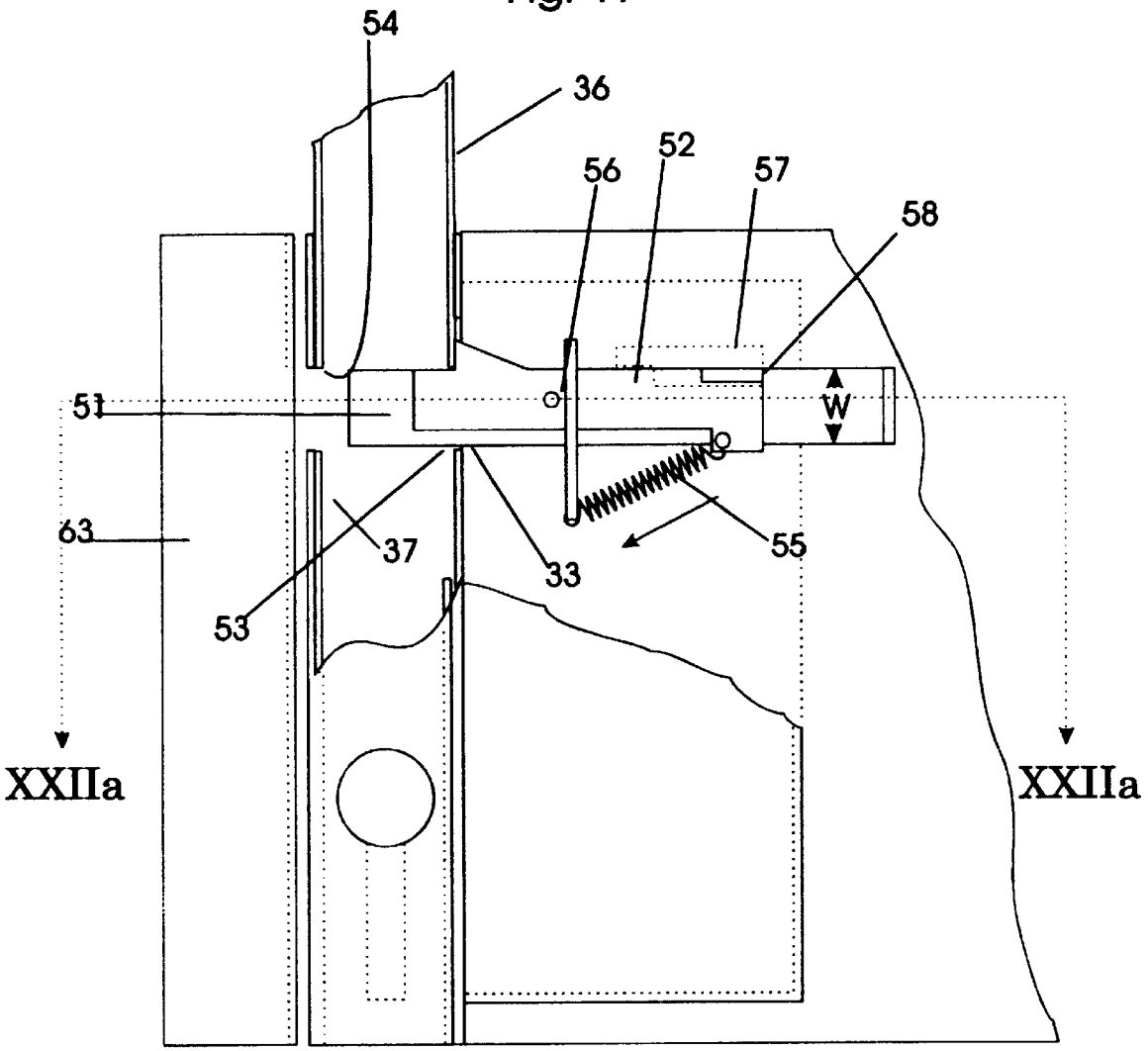
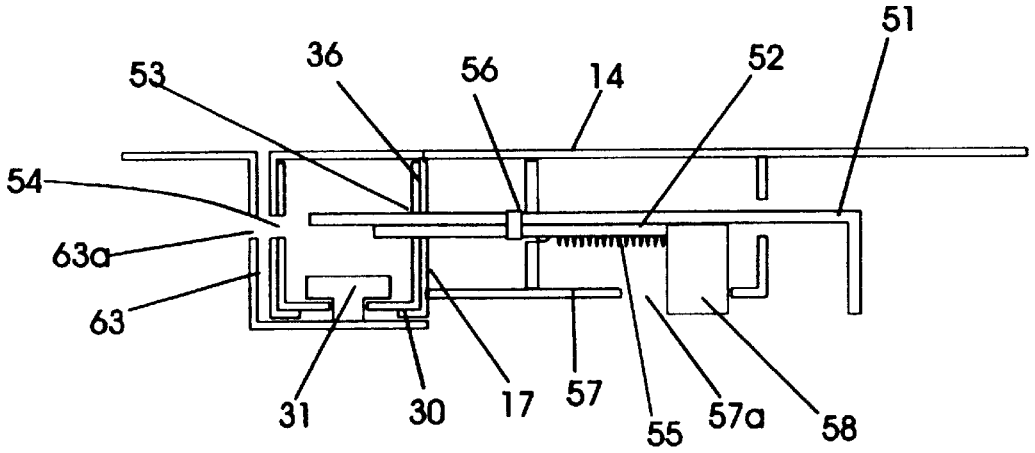
Fig. 22a

Fig. 18
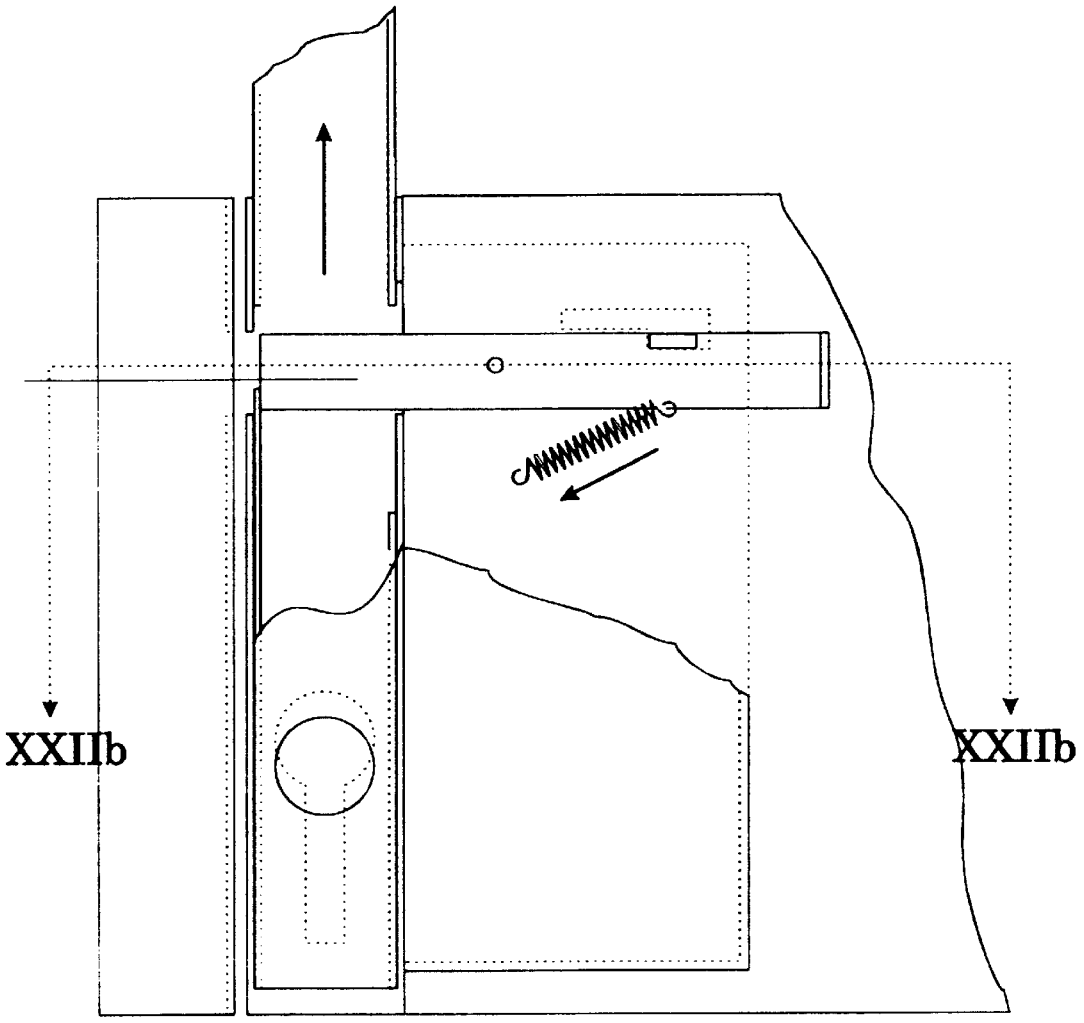
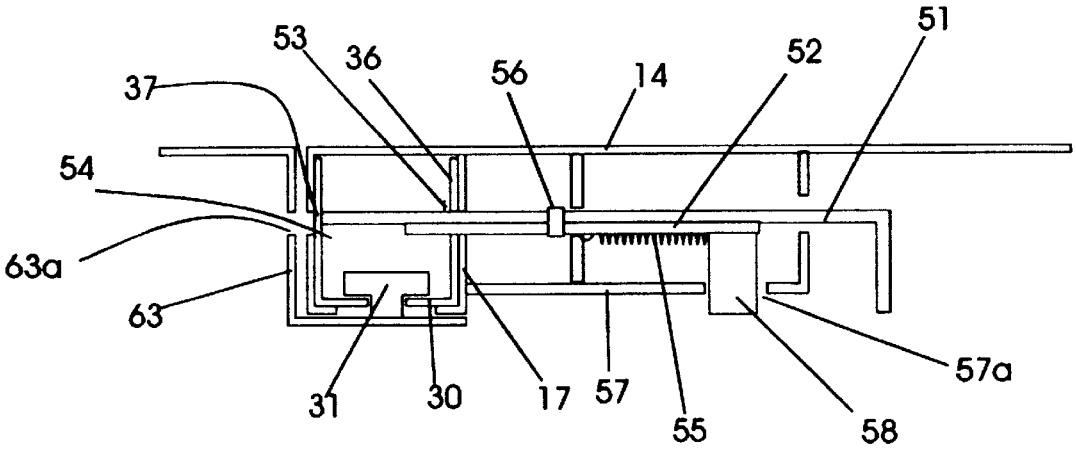
Fig. 22b

Fig. 19
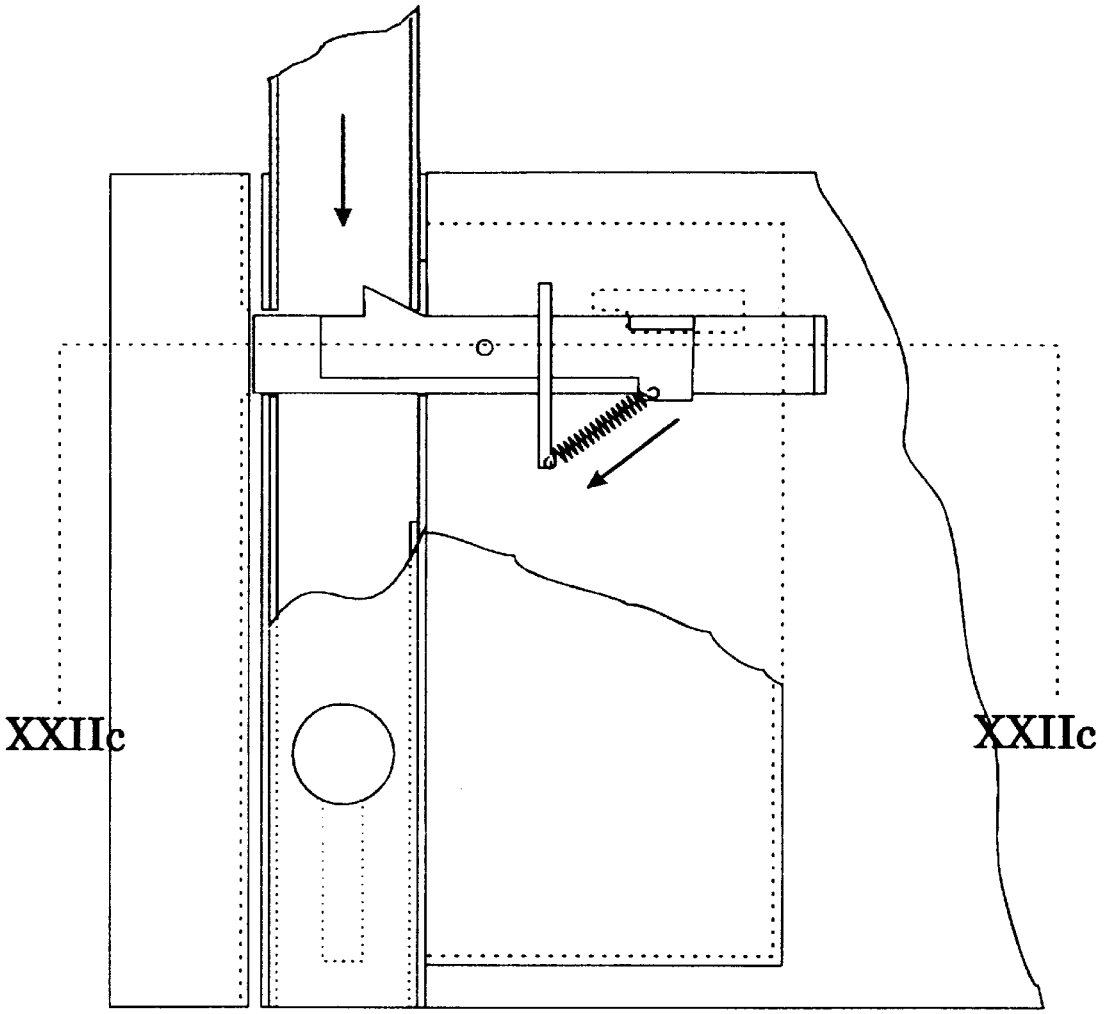
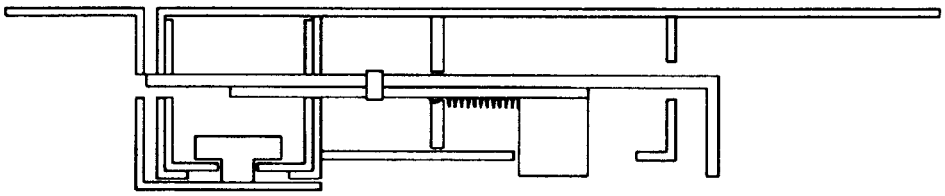
Fig. 22c

Fig. 20
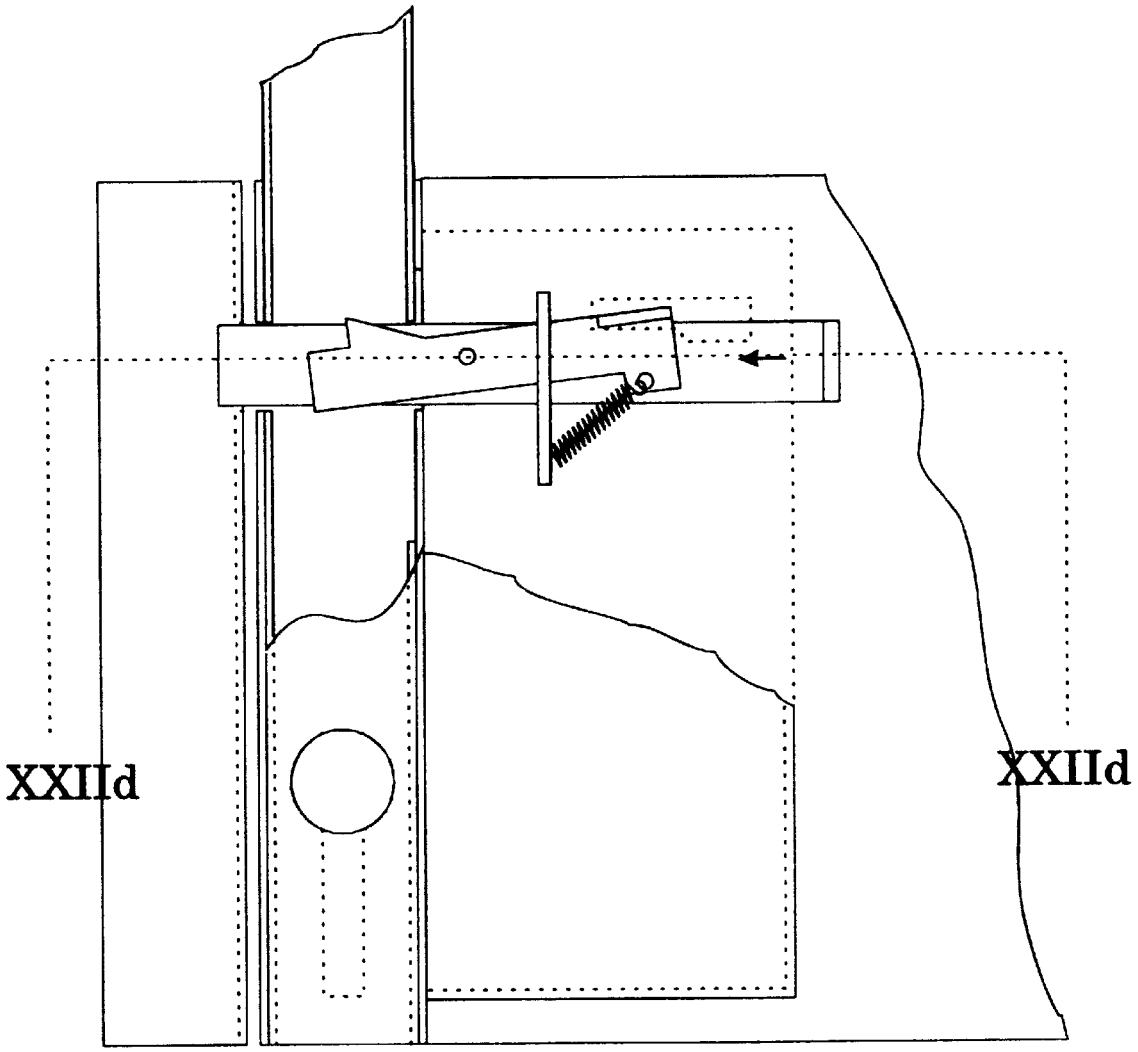
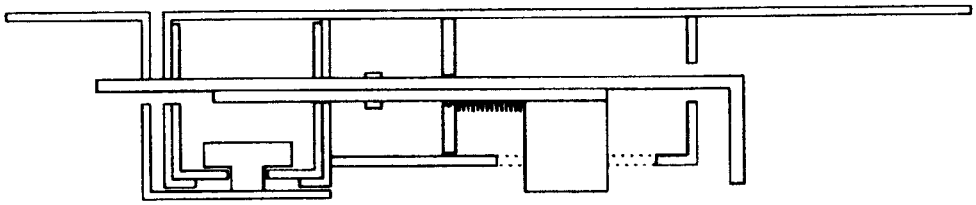
Fig. 22d

Fig. 21
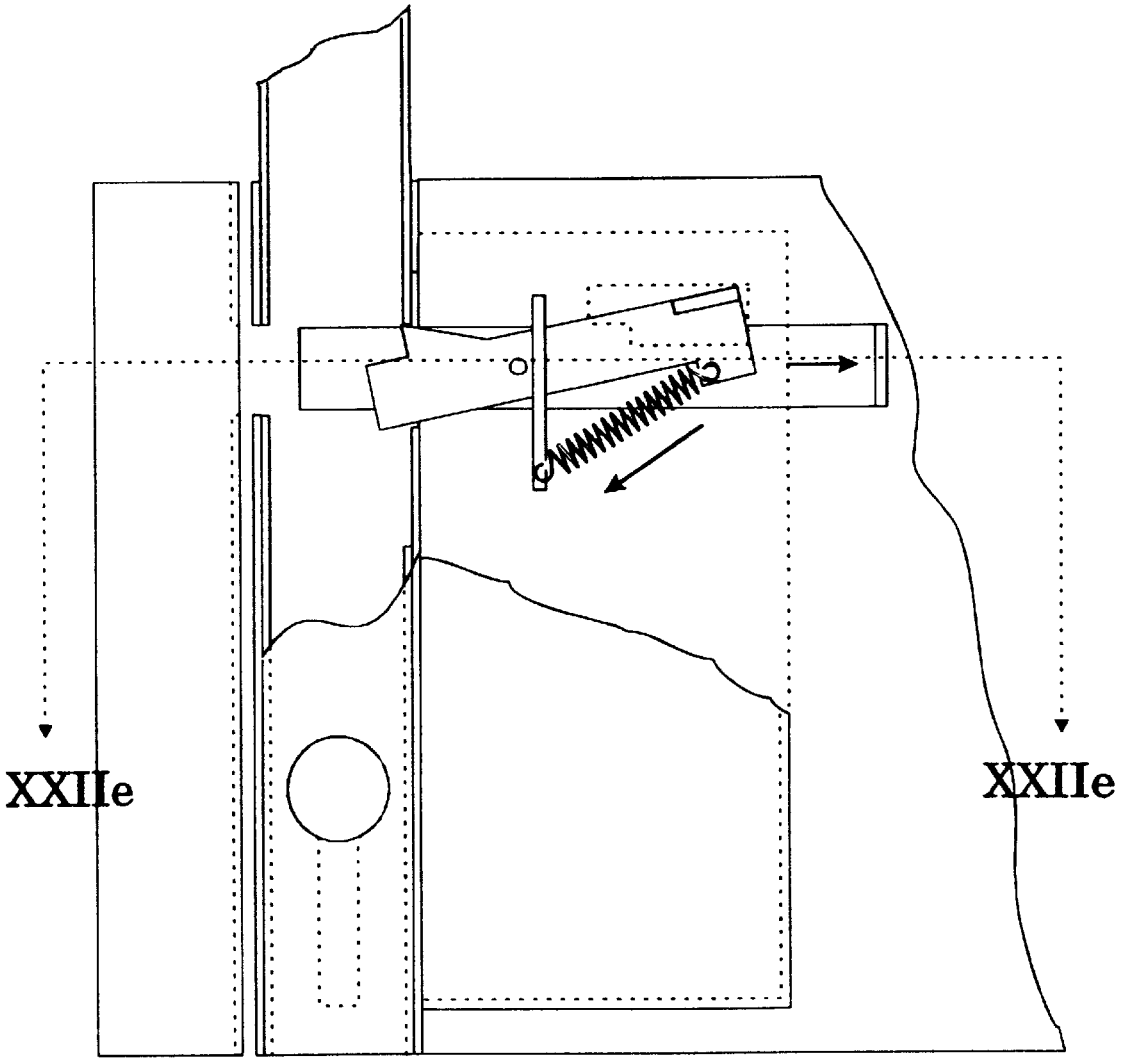
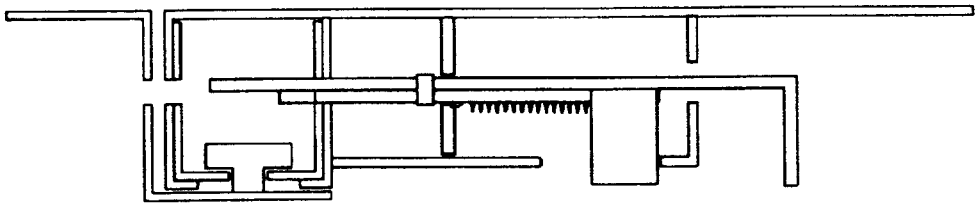
Fig. 22e

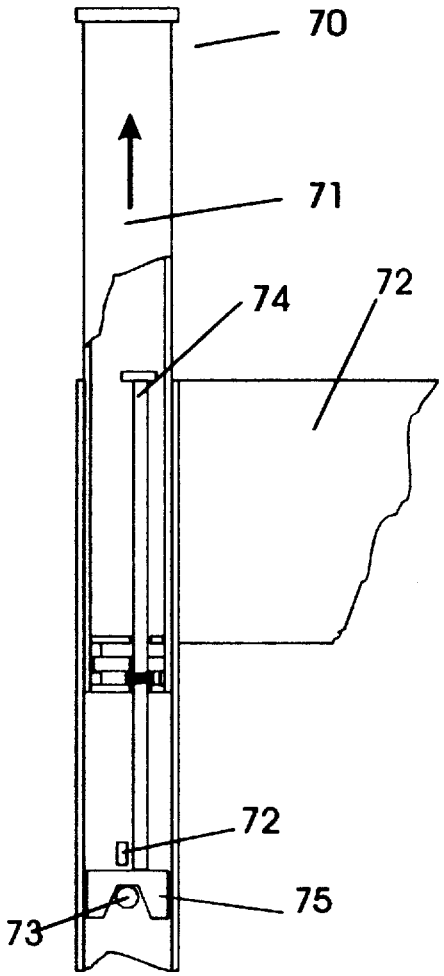
FIG. 28
Fig. 29
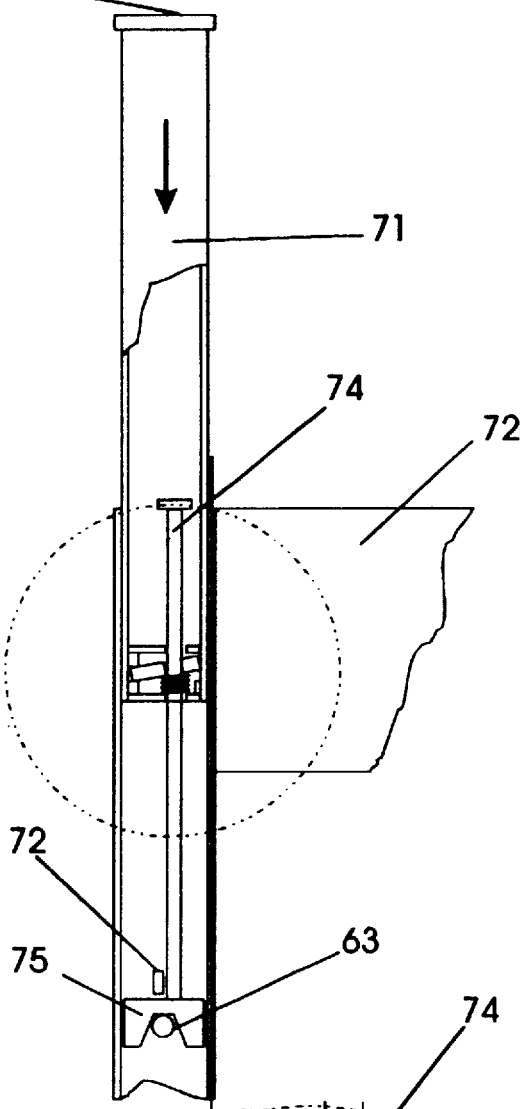
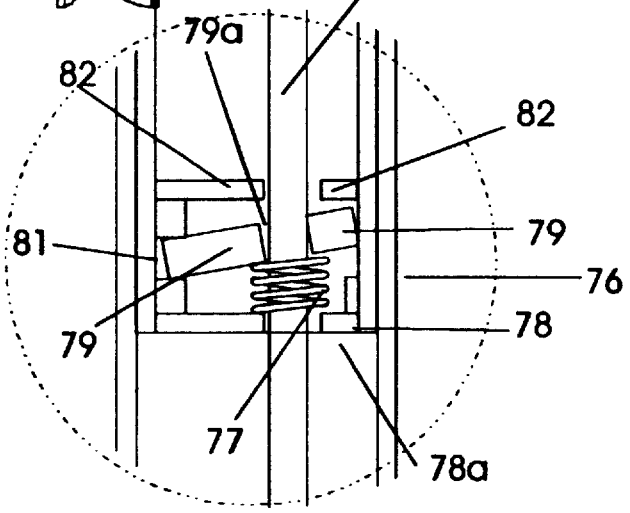
Fig. 30

LOCKING MECHANISM

BACKGROUND OF THE INVENTION

1. Field of the Invention

The present invention relates to a locking mechanism for security door assemblies, in particular but not exclusively, to a security door assembly which is fitted temporarily on a building.

2. Description of the Prior Art

If a building is left vacant for more than a short period of time, for example to carry out renovation works, it becomes vulnerable to people breaking into the building for the purposes of theft, squatting or vandalism. The normal doors and windows of a building do not provide a high degree of security so it is known to cover the windows to make it more difficult to enter into the building.

A rudimentary way of covering an entrance way is to fasten a wooden board over the outside of the window or door, but this is relatively easy to remove by someone determined to enter the building.

It is known to provide security door assemblies which offer a higher degree of security than the above-mentioned rudimentary approach. A security door assembly which is secured over an existing entrance way in to a building is described in EP 0 141 623. The assembly comprises a door hingedly mounted in a frame with the assembly braced in the entrance way. The assembly is provided with locks which prevent the door from moving about its hinges from a position located in the door frame.

The security door assemblies are normally temporarily installed on a building, as mentioned above during renovation or building works. The known door assemblies incorporate mortice locks to secure the door in the door frame because mortice locks provide straightforward fitting and a reasonable degree of security.

Mortice locks do, however, have a number of disadvantages. Firstly, the keyhole allows the possibility that the lock can be picked. In order to decrease the likelihood of this occurring, complex and expensive locking mechanisms are often used and some manufacturers only use their own locks on their doors. The use of such complex locks in itself can be disadvantageous because this requires the change of complete locking mechanisms when a door is moved from site to site.

A particular manufacturer/source is likely to have many thousand doors in circulation at any time, with many thousands of people having keys to one or more of the doors. The above factors mean that there is a likelihood that some people may have the keys to a door which they are not authorised to enter. Commercially, this means that the issue and return of keys must be carefully monitored and also that installation teams from the manufacturer/source have to carry a key of every design manufactured which is expensive and prone to the possibility of theft of a full set of keys.

Further, mortice locks are prone to vandals causing damage to the locks by inserting glue into the keyhole, or by trying to force the locks. It is known to put sliding covers in the keyhole to prevent such abuse, but this does not entirely overcome the problem.

The overall effectiveness of the locks against forced, otherwise unauthorised entry, is clearly of primary importance with security door assemblies.

SUMMARY OF THE INVENTION

The present invention seeks to provide a more secure door assembly.

According to the present invention there is provided a locking mechanism comprising a locking member moveable between a locking state and non-locking state, a lock releasably engageable with the locking member to prevent the locking member moving to the non-locking state, and an operating means coupled to the locking member by connecting means which includes a force limiter, which force limiter limits the force the operating means can apply to the locking member without damage to any parts of the locking mechanism.

The locking mechanism of the present invention has the advantage that only a limited force can be applied to the locking member which otherwise provides a simple way of forcing the lock. It is important that the force limiter does not allow any substantial damage to the locking mechanism as the door may not be operable if damage was caused. If, for example, the force limiter worked by deformation of an inexpensive and easily replaced member (e.g. a bar or a plate), this would not be suitable for temporary security door installations where access is often impossible to the interior of the door to repair the minor damage.

Preferably, the force limiter comprises a lost motion means and the operating means is movable from a first position to a second position, whereby movement of the operating means from the closed position to the open position moves the locking member to the non-locking state if the lock is not engaged with the locking member, and movement of the operating means from the closed position to the open position is absorbed by the lost motion means if the lock is engaged with the locking member. This arrangement provides that the secondary lock cannot be forced through movement of the main locking member.

Preferably, the operating means is movable to an intermediate position before the lock prevents further movement of the locking member and the lock is only releasable from engagement with the locking member when the operating means is in the intermediate position.

The lock normally comprises one or more of an electric release (or electronic lock) and/or a mortise lock. In the case of a mortise lock, for example, the keyhole may only be uncovered when the operating means has been moved, for example the movement of a handle by ninety degrees. In the case of an electric release, again for example, the movement of the handle closes a switch which completes a circuit, such as the power circuit, of the lock.

Optionally, the locking mechanism further includes latch means biased into a restraining position in which the operating means is prevented from moving the lock from the locking state and optionally the restraining member includes a stop preventing movement of the locking member beyond the unlocked state. This provides a tertiary level of security to the locking mechanism.

Preferably, the locking mechanism is fitted with a lock-in prevention latch which releasably engages the locking member to prevent movement from unlocked state. This prevents accidental lock-in of workmen inside the building by the security door.

BRIEF DESCRIPTION OF THE DRAWING

An embodiment of the present invention will now be described with reference to the accompanying drawings in which:

FIG. 3 shows a section view on an enlarged scale of the lock mechanism shown in FIG. 2 in a first position;

FIG. 4 shows a section view along the lines IV—IV of FIG. 3 with the lock mechanism in a first position;

FIG. 5 shows the view of FIG. 3 with the lock mechanism in a second position;

FIG. 6 shows the view of FIG. 4 with the lock mechanism in the second position and more particularly, a section view along line VI—VI of FIG. 5;

FIG. 7 shows the view of FIGS. 3 with the lock mechanism in a third position;

FIG. 8 shows the view of FIG. 4 with the lock mechanism in the third position and more particularly, a section view along line VIII—VIII of FIG. 7;

FIG. 11 shows the view of FIG. 3 with the lock mechanism in the fifth position;

FIG. 12 shows the view of FIG. 4 with the lock mechanism in fifth position and more particularly, a section view along line XI—XI of FIG. 11;

FIG. 14 shows an enlarged view of a portion of FIG. 1;

FIG. 15 shows a sectional view along the lines XV—XV of FIG. 14;

FIG. 17 shows the enlarged view of the latch mechanism shown in FIG. 2 in a first position;

FIG. 18 shows the latch mechanism of FIG. 17 in a second position;

FIG. 19 shows the latch mechanism of FIG. 17 in a third position;

FIG. 20 shows the latch mechanism of FIG. 17 in a fourth position;

FIG. 21 shows the latch mechanism of FIG. 17 in a fifth position;

FIG. 22*a*) shows a sectional view along the line XXIIa—XXIIa of FIG. 17 showing one of five illustrated positions of the latch mechanism.

FIG. 22*b*) shows a sectional view along the line XXIIb—XXIIb of FIG. 18 showing one of five illustrated positions of the latch mechanism.

FIG. 22*c*) shows a sectional view along the line XXIIc—XXIIc of FIG. 19 showing one of five illustrated positions of the latch mechanism.

FIG. 22*d*) shows a sectional view along the line XXIId—XXIId of FIG. 20 showing one of five illustrated positions of the latch mechanism.

FIG. 22*e*) shows a sectional view along the line XXIIe—XXIIe of FIG. 21 showing one of five illustrated positions of the latch mechanism.

FIG. 28 shows a partly sectional view of the top mounting means of the door assembly of FIG. 23 in a first position;

FIG. 29 shows the top mounting means of FIG. 28 in a second position;

FIG. 30 shows an enlarged view of the dotted region of FIG. 29;

DETAILED DESCRIPTION OF THE PREFERRED EMBODIMENT

Figure 1:
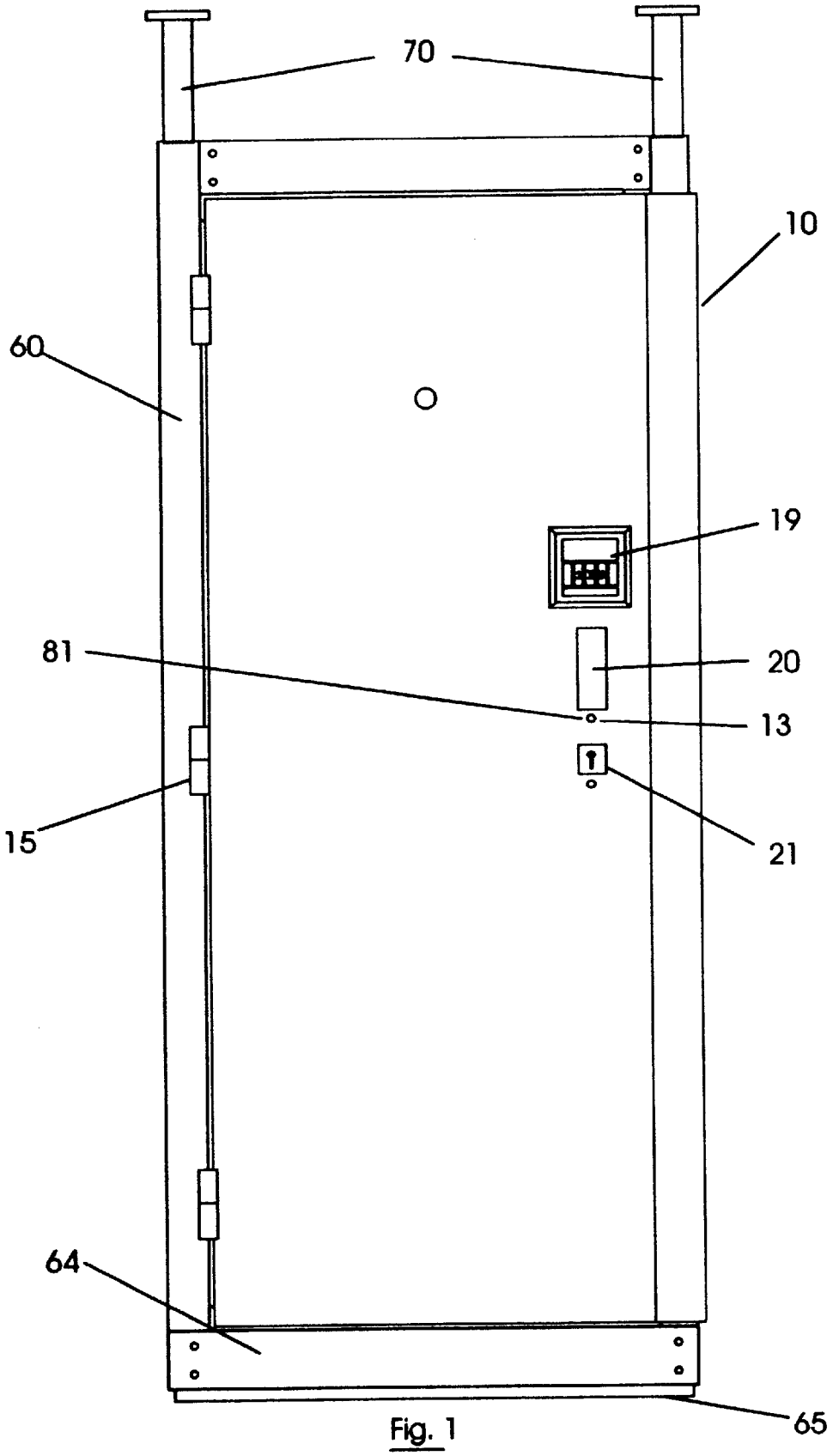
FIG. 1 shows a front plan view of a door assembly according to a preferred embodiment of the present invention.
Figure 2:
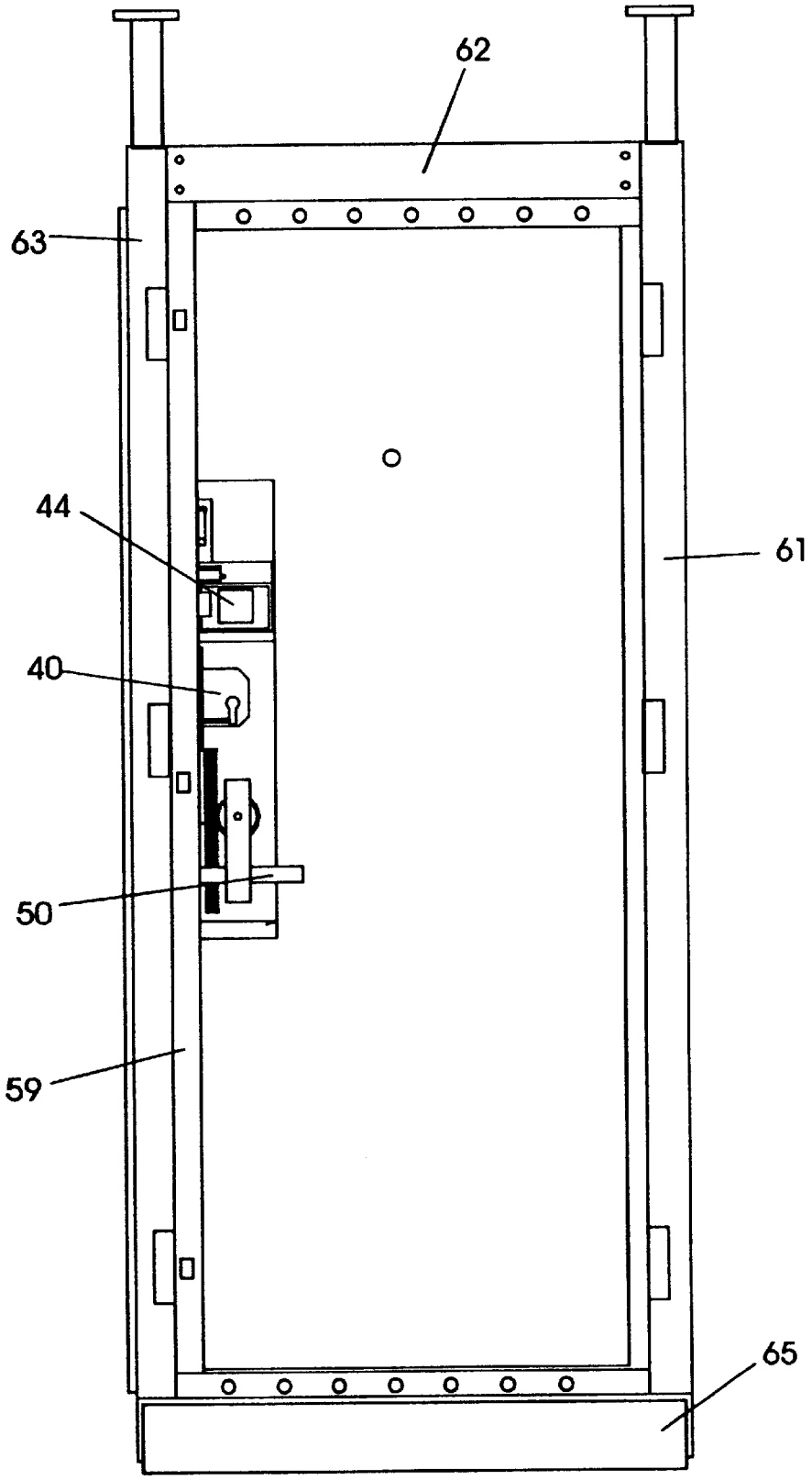
FIG. 2 shows a rear plan view of the door assembly of FIG. 1.
Figures 9, 10:
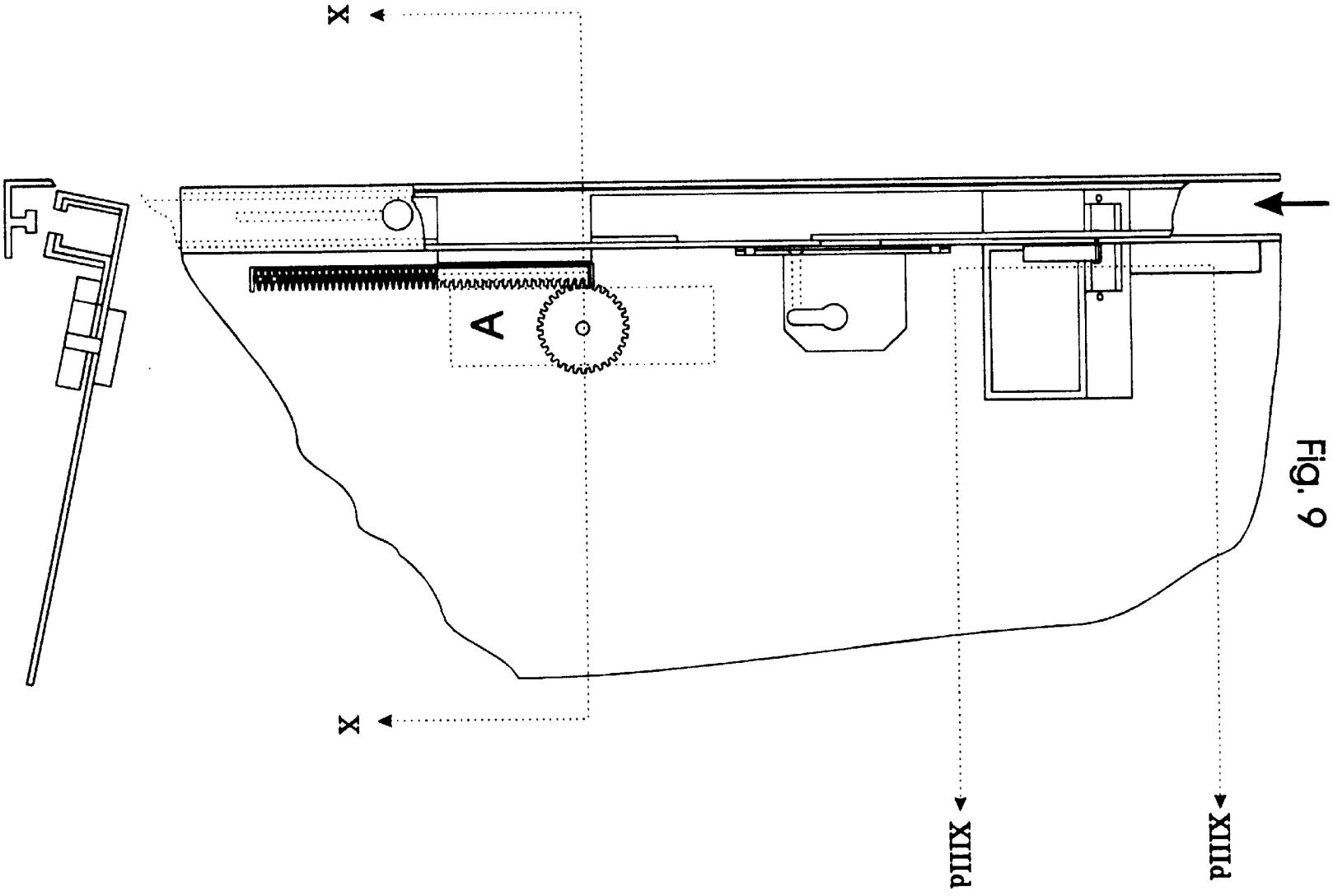
FIG. 9 shows the view of FIG. 3 with the lock mechanism in the fourth position.
FIG. 10 shows the view of FIG. 4 with the lock mechanism in the fourth position and more particularly, a section view along line X—X of FIG. 9.
Figure 13:
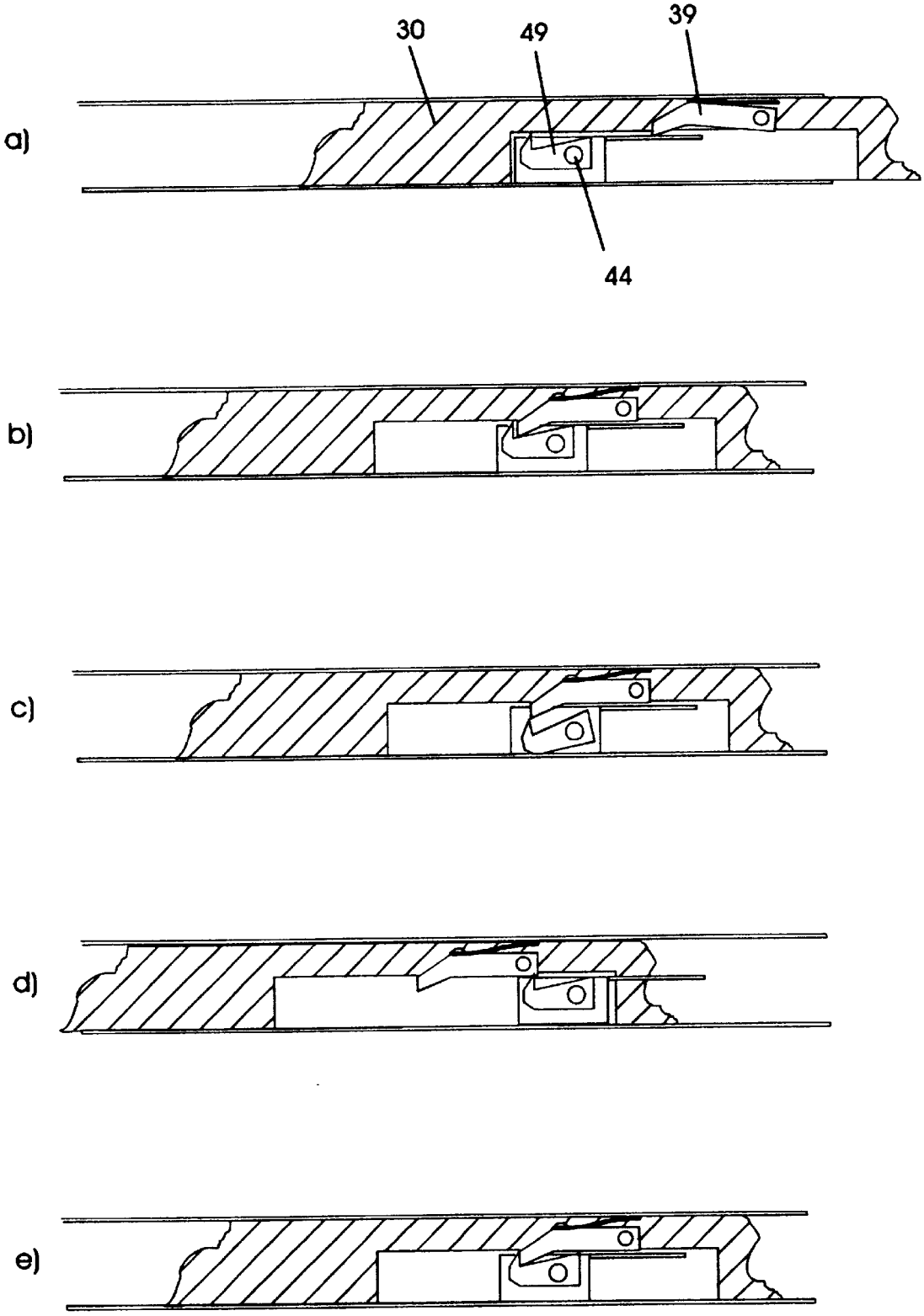
FIG. 13*a*) shows a sectional view along the line XIIIa—XIIIa of FIG. 3 showing one of five illustrated positions of the locking mechanism.
FIG. 13*b*) shows a sectional view along the line XIIIb—XIIIb of FIG. 5 showing one of five illustrated positions of the locking mechanism.
FIG. 13*c*) shows a sectional view along the line XIIIc—XIIIc of FIG. 7 showing one of five illustrated positions of the locking mechanism.
FIG. 13*d*) shows a sectional view along the line XIIId—XIIId of FIG. 9 showing one of five illustrated positions of the locking mechanism.
FIG. 13*e*) shows a sectional view along the line XIIIe—XIIIe of FIG. 11 showing one of five illustrated positions of the locking mechanism.
Figure 16:
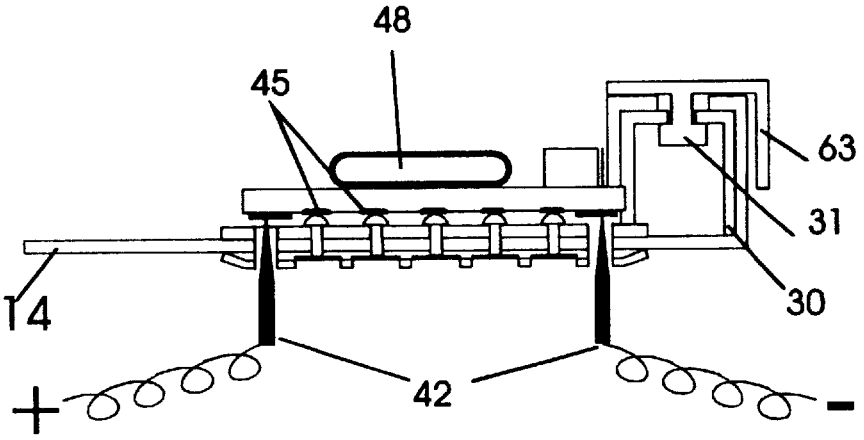
FIG. 16 shows the view of FIG. 15 with an external power source/tester shown schematically.

FIG. 1 and FIG. 2 show a security door arrangement 10 for mounting exteriorly to a dwelling or other building entrance. The door arrangement 10 comprises a door frame 60 on which is hingedly mounted a door 12. Normally, the door frame 60 will be mounted in an existing doorway of the dwelling braced between the door jamb, the threshold and the lintel of the entrance way, or affixed to the existing frame.

The door 12 is mounted to the door frame 60 on hinges 15 to move hingedly between an open position where the exterior surface of the door 12 is not aligned with the exterior surface of the frame 60 and a closed position where the exterior surface of the door 12 and the frame 60 are substantially coplanar. In the closed position, the door frame 60 prevents any substantial vertical, horizontal, or rotational movement of the door 12 in the door frame 60.

In the Figures, the door frame 60 comprises an upright hinged side member 61 joined at the top to one end of a top frame member 62 which joined at the other end to a lock side member 63. The two side members 61, 63 are joined at the base by bottom frame member 64 to define a door opening. The lock side member 63 has a flange plate 59 extending into the door opening which abuts a cross plate of a U-shaped channel 17 of the door 12. The flange plate 59 has cams 31 mounted thereon. A further U-shaped member 16 is attached on the lock side of the main door panel 14 to enclose that side member 63 of the door frame. This is to protect the door assembly from forced entry by insertion of levers into the gap between the door frame 60 and the door 12.

The door 12 comprises a main door panel 14 with inwardly extending flanges. The door panel 14 is the same size as the opening in the door frame 60. The door is hinged on one side and has a door member 16 fixed on the other side of the door panel 14. The door member comprises a U-shaped section extending along the whole side of the door panel 14. One side of the U-shaped section is in face to face contact with the inwardly extending flange of the door panel 14. When the door is in the closed position, the door member 16 extends around the side member 63 of the door frame 60 with the rear frame panel 59.

In the illustrated embodiment, the hinges 15 are mounted with the pivot extending outwardly from the exterior surface of the door frame 60. If the hinges 15 are cut to separate the door 12 from the door frame 60, the door 12 cannot be removed from the door frame 60 because of members (not shown) extending from the inner flange of the door 12 into associated openings in the opposed surface of the door frame 60 and members (not shown) extending from the inner flange of the door frame 60 into associated openings in the opposed surface of the door frame inner flange. Alternative securing means could also be used (for an example see below).

The door arrangement 10 is fitted with security locks to prevent the door 12 moving from the closed position to the open position. The locks may take the form of normal mortice locks with or without disguised keyways or other similar anti-vandal devices. In the illustrated embodiment, the door is fitted with the following three-tier security arrangement.

The door 12 has a handle 20 mounted on the exterior surface of the door 12. Handle 20 is used as the operating means for moving the door 12 between the open and closed positions.

As shown in greater detail in FIGS. 3 to 13, handle 20 (shown in dotted outline) is mounted on a pivot 22 which pivot 22 extends perpendicularly to the exterior plane of the door 12. The handle 20 can rotate 180 degrees about said pivot 22 on the exterior surface of the door panel 14. Rotational movement of the handle 20 rotates gear 24 mounted on the pivot 22 on the interior surface of the door panel 14.

Gear 24 meshes with rack 25 so that rotation of the gear 24 causes vertical motion of the rack 25. Rack 25 is slidably mounted on support 26. Support 26 is connected to a sliding espagnolette 30.

Espagnolette 30 catches on three cams 31 mounted on the rear frame plate 59 of the door frame 60. The engagement between the espagnolette 30 and the cams 31 forms the main lock of the security door assembly 10. In the embodiment shown the espagnolette 30 is mounted in a U-shaped channel 17 mounted on the interior surface of the door panel 14. The cross member of the channel 17 in which the espagnolette 30 is mounted abuts the rear frame plate 59 when the door 12 is in the closed position.

The espagnolette 30 comprises a U-shaped plate fitted in a slidable manner within the channel 17. The cams 31 extend through holes in the cross member of the channel 17. The espagnolette 30 has a slot 32 (shown in dotted outline in FIG. 3) with widened slot sections 33 (shown in dotted outline in FIG. 3) through which the cams 31 can move. The other sections of the slot 32 are narrowed so as to engage with the rear side of the cam 31 to thus prevent movement of the door about the hinges and so as to lock the door 12 in the closed position unless the widened slot sections 33 align with the cams 31.

The espagnolette 30 is slidably movable with the support 26. The espagnolette 30 has at least one opening 38 formed in one of the side arms thereof. Through the opening 38 bolt 41 of a mortice lock 40 extends to prevent sliding movement of the espagnolette 30.

Mortice lock 40 has a key hole in the exterior surface of the door panel 14. In the illustrated embodiment this key hole is located behind the handle 20 when in a first position. In the drawings the handle 20 is shown oversized, and in normal installation the mortice lock 40 will be mounted closer to the pivot 22. By locating the key hole behind the handle 20, vandalism of the mortice lock 40, for example by inserting glue or other devices in through the key hole, is deterred. The key hole becomes accessible when the handle 20 is rotated through 90 degrees in order for the mortice lock 40 to be operable.

The illustrated embodiment further includes an electric release 44 (or other electronic lock mechanism), as best shown in FIGS. 13 to 16, which operates an actuating arm 49 which catches against a catch member 39 on the espagnolette 30 to also prevent sliding movement of the espagnolette 30. The electric lock 44 is operated via a microswitch key pad 45.

A microswitch key pad 45 of the lock 44 is mounted on the rear surface of the door panel 14. A metal plate is mounted on the exterior surface of the door panel 14. The metal plate has a finger pad 19 on the front surface thereof. The finger pad 19 may be disguised as a changeable street number of the door assembly. The finger pad 19 comprises a plate with fingers 46 cut into the surface thereof. Depression of any finger 46 presses against an associated actuating member 47 which extends through the door panel 14. The actuating members 47 each actuate a respective microswitch of the microswitch key pad 45. In the illustrated embodiment the actuating member 47 takes the form of a bar, but it is preferred for the actuating member to take the form of a ball bearing, e.g. of nylon.

The microswitch key pad could, of course, be located on the exterior surface of the door in an armoured case, in a conventional manner. However, this is considered to be less secure than the illustrated embodiment because the microswitch keypad is more vulnerable to vandalism or other unauthorised tampering.

The microswitch key pad 45 operates the electric release 44 if the correct combination is input into the key pad 45. The electric release 44 then actuates an actuating arm 49 which latches or unlatches the catch member 39 of the espagnolette 30 (as shown in FIGS. 13*a* to 13*e*).

Normally, the security door arrangement 10 would contain either the mortice lock 40 or the electric release 44. However, if desired the door arrangement can incorporate further mortice and/or electric releases.

The espagnolette 30 is prevented from movement by the mortice lock 40 and/or electric release 44. However this or these locks 40, 44 is/are comparatively easy to force compared to the espagnolette/cam locking mechanism.

A great deal of force could be applied to the mortice lock or electric release via the espagnolette/handle arrangement. In order to prevent such an unauthorised forcing of the mortice and/or electric release, the locking mechanism of the present invention includes a force limiting device.

The rack 25 of the espagnolette 30 is mounted slidably on the support 26. The rack 25 is movable relative to the support 26 against the action of a force limiting or loss motion device. In the present case the loss motion device takes the form of a spring 23. The spring 23 is fixedly mounted at one end to the door panel and attached to the rack mechanism at the other end. In a preferred embodiment (not shown), the spring 23 is housed in a separate assembly which is attached to rack 25.

If the handle 20 is turned with the mortice and/or electric releases 40, 44 preventing movement of the espagnolette 30, the force of turning the handle 20 is transmitted to the rack 25 via the gear 24. The spring 23 has a spring force less than the force required to break either the electronic and/or the mortice locks 40, 44.

In the illustrated embodiment, the electronic and mortice locks 44, 40 do not prevent all movement of the espagnolette 30. Rather, the locks engage the espagnolette 30 when the handle 20 is rotated about 90 degrees into an intermediate position (shown in FIG. 5). No pressure is thus put on the locking mechanism of the mortice or electric release 40, 44 during movement to the intermediate position of the handle 20.

Consequently, the lost motion means 23 absorbs the motion of the handle so that the espagnolette 30 is permitted to move during this first 90 degrees of motion of the handle. During the second 90 degrees of motion of the handle, the spring 23 absorbs the force transmitted from the gear 24 to the rack 25 by allowing the rack 25 to slide in the support 26 if the espagnolette is prevented from moving by the mortice or electric release 40, 44. This is best illustrated in FIGS. 3 to 13.

In order to absorb this motion effectively it is necessary that the spring force is sufficiently less than the force required to damage the bolt of the electronic and/or mortice locks 44, 40. Further, the difference between the natural length of the spring 23 and its compressed length must be at least as great as the distance the rack 25 is required to move.

If the mortice and/or electric releases 40, 44 do not bar further movement of the espagnolette 30, (i.e. in the case of authorised entry) the rotation of the handle 20 from the intermediate position to the second position causes further sliding of the espagnolette 30 to the espagnolette position where the enlarged section 33 of the slot 32 allows movement of the cams 31 through the espagnolette 30. The spring 23 does not absorb the further movement of the handle 20 because there is insufficient force acting against the spring force.

The handle 20 is prevented by a stop 18 from turning more than 180 degrees. The stop 18 is mounted, in the illustrated embodiment on a restraining plate 28 (described in more detail hereinafter) and extends outwards from the exterior face of the door panel 14 into a channel (shown in dotted outline in FIGS. 32 and 33) provided in the rear face of the handle 20. The channel has a portion which extends in semicircle (thus setting the 180 degree limit to movement of the handle) of radius r, where r equals the distance from the pivot 22 to the stop 18. The stop 18 is adjacent to a first end of the channel portion in the initial position of the handle and is adjacent to the other end of the channel in the unlocked position of the door.

The spring 23, therefore, does not need to absorb more than the 90 degrees of motion of the handle 20. Even though the spring does absorb motion of the handle past the 180 degree position, no force can be applied to the mortice and electric releases 40, 44 due to the stop and the gear 24 attempting to run past the end of the rack 25.

The illustrated embodiment has the advantage that the first 90 degrees of movement of the handle 20 to the intermediate position occurs before any of the aforementioned locks 30/31, 40, 44 are unlocked. The key hole for the mortice lock 40 is located behind the normal position of the handle 20, thus disguising the key hole from potential vandals, etc. Furthermore, the electric release 44 is not powered until the handle 20 is in the intermediate position.

An alternative force limiter to the spring 23 is mounting the rack 25 in a manner where the rack 25 is biased against the gear 24. The rack 25 then moves out of engagement with the gear 24 if excessive force is applied to the handle 20. However, this embodiment is not preferred because the handle 20 and the rack 25 loses synchronisation when the force limiter operates, which subsequently can cause further problems with the assembly 10. For example, the handle 20 may now cover the mortice lock keyhole in the intermediate position.

In contrast, the spring 23 returns the mechanism to its original condition after it is used.

Figure 32:
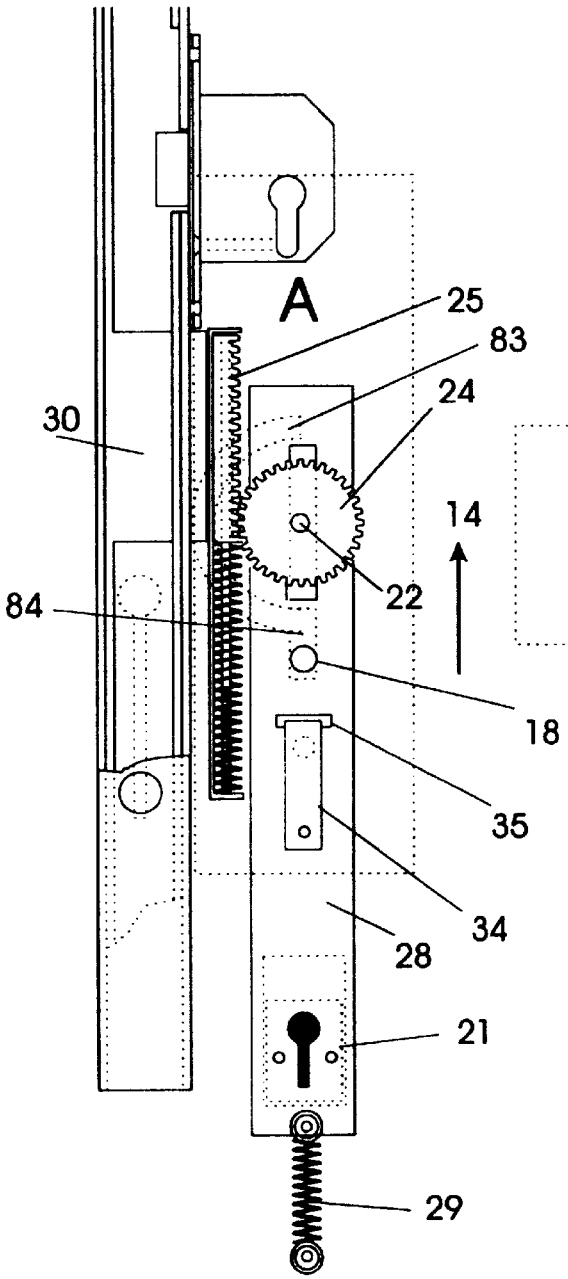
FIG. 32 shows an enlarged view of FIG. 2 illustrating a latching mechanism in a restraining position.
Figure 33:
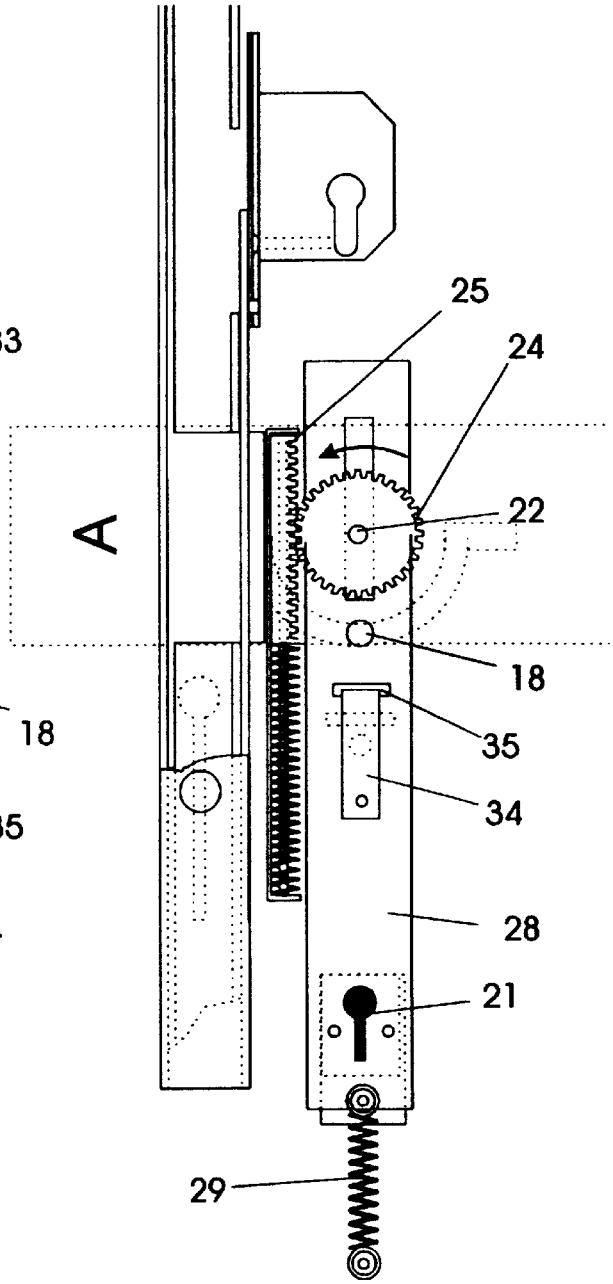
FIG. 33 shows the latching mechanism of FIG. 32 in a release position.

In order to prevent the unauthorised movement of the handle 20 through the first 90 degrees of movement, the illustrated embodiment incorporates a further restraining device. The restraining device comprises the aforementioned restraining plate 28 mounted on the interior surface of the door panel 14 (as shown in FIGS. 32 and 33), the restraining plate 28 being elongate and having an opening therein through which the pivot 22 extends. The restraining device includes the stop 18 used to limit movement of the handle 20 to 180 degrees extending therefrom through the door panel 14 into a channel 83 in the handle. The channel in the handle 20 has an extension 84 extending downwardly from first end of the semicircle portion of the channel. The restraining plate 28 is slidable between a restraining position in which rotation of the handle 20 is blocked by engagement with the stop 18 extending into the lower part of the channel extension and a release position in which the stop extends into the first end of the semicircular channel. The restraining plate 28 is biased by spring means 29 into its restraining position, thus normally preventing the rotation of the handle 20.

A false key hole plate 21 (shown in FIG. 1) is provided on the exterior surface of the door panel 14. The keyhole plate 21 is rigidly connected to the restraining plate 28 (shown in FIGS. 32 and 33) and is slidable therewith. By sliding the keyhole plate 21, the restraining plate 28 is moved to its release position where the handle 20 can be rotated. The sliding of the disguised keyhole plate 21 is against the force of the spring means 29 acting on the restraining plate 28 and therefore the keyhole plate 21 is biased back to its initial position.

In the illustrated embodiment, the restraining plate 28 has a leaf spring finger 34 latching the restraining plate 28 in its restraining position and preventing movement of the keyhole plate 21. The spring finger 34 is mounted at one end on the restraining plate 28 to extend longitudinally on the inward side thereof. At the other end of the spring finger 34 a latch portion 35 is biased through a slot provided in the restraining plate 28 into a recess provided on the interior surface of the door panel 14. Inward pressure on the leaf spring finger 34 adjacent to the slot in the retaining panel 28 disengages the latch portion 35 from the recess in the door panel 14. Movement of the disguised key hole plate 21 is then possible thereby allowing movement of the restraining plate 28 into its release position.

The biasing of the spring finger 34 ensures the re-engagement of the latch portion 35 with the recess in the door panel 14 when the inward force is not applied to the spring finger 34 and the restraining plate 28 is in its restraining position. The restraining plate 28 remains in the release position until the handle 20 returns to its locked position due to engagement of the stop 18 in the semicircular channel portion.

A hole 13 is provided through the door panel 14 aligned with a hole in the restraining plate 28 when in its restraining position. Push means (not shown) inserted through the hole 13 can be used to exert the inward pressure on the spring finger 34, thereby allowing operation of the restraining device from the exterior of the door 12. This provides another hidden lock in the door arrangement 10 as it is unlikely that any unauthorised user would realise that it would be necessary to insert push means through the hole 13 in the door panel 14 in order to slide the disguised keyhole plate to release the handle 20 so that the handle 20 can turn.

Further arrangements (not shown) of the latching mechanism could be provided by the skilled artisan such as the spring finger being mounted on the interior of the door panel latching onto the restraining plate.

A security bolt 81 could be mounted in the hole 13, which upon turning or pushing could form the push means, or alternatively the security bolt 81 may require removal before allowing insertion of a separate push means to then disengage the leaf spring with the socket. The security bolt 81 could even engage directly into the restraining plate 28 to prevent movement of the restraining plate 28 if the bolt is not removed. Each of these non-illustrated embodiments could provide alternative or further disguised lock means. Of course, if desired the latching means could be omitted from the restraining means.

The disguised keyhole plate 21 is especially advantageous as this can be disguised to look like a key hole for a normal mortice lock. In fact a normal locking barrel could be mounted behind a disguised keyhole in the keyhole plate 21 to further improve this disguise. Vandals would then attack this obvious lock in order to gain entry to the door, or to put glue or other entry-barring means onto the door. Of course, as the disguised keyhole has no effect on the locking door this would not prevent authorised entry into the building.

The authorised entry to the building through the security door assembly of the present invention is accomplished as follows:

1) The operator uses a push member to disengage the latch portion 35 of the spring finger 34 from the recess.
2) The disguised key hole plate is then moved upwardly.
3) The handle 20 is then rotated 90 degrees without allowing the disguised keyhole plate 21 to return to its initial position. The keyhole for the mortice lock 40 is revealed and the power supply to the electric release 44 is switched on. (The operator may remove the push means from the hole 13). The restraining plate 28 is thus held against the spring means 29.
4) The operator then unlocks the mortice lock 40 with a key and enters the correct code into the electric release 44 via the finger pad 19 located above handle 20. This releases the locks 40, 44 preventing movement of the espagnolette 30.
5) The operator then rotates the handle 20 an additional 90 degrees to move the espagnolette 30 to its open position where the cam is movable through the widened slot sections 33 of the espagnolette 30.
6) The handle 20 is then pulled to rotate the door 12 about the hinges 15 to open the security door arrangement 10.

Clearly the door offers several levels of security which can be added to, or subtracted from, as required. For example several mortice locks could be incorporated into the door, all of which would need undoing. For example, the restraining plate 28 could be removed so that the handle 20 is not prevented from the first 90 degrees of movement if less security is required.

In the electric release 44 (shown best in FIGS. 13 to 16), the arrangement for actuating the microswitch keypad via finger pad 19 requires very little movement of the fingers 46 to operate the micro-switches and so the movement required is not readily detectable by someone tapping the finger pad 19. This acts as a further disguised locking mechanism. As the lock is not powered until the handle has rotated 90 degrees, this will act as a entry prevention device because any person attempting to operate the lock prior to turning the handle will not be able to operate the electric release. In fact, such a person is unlikely to realise that the disguised finger pad 19 is actually for operating one of the door locks due to the very limited movement of the finger pad 19. This has several advantages. Firstly the unauthorised user may not realise there is an electric release and thus not realise that one needs to be broken. Secondly, the unauthorised user has no opportunity to continually enter combinations into the key pad in order to determine the code for the electric release without having first moved the handle by 90 degrees each time before the lock is operated.

Electric releases however represent a problem on security doors. As the electric releases are battery operated the doors are prone to failure by the battery 48 becoming exhausted. With a security door of this type it cannot be easily opened and the building may thus become pseudo-permanently secured, which is obviously undesirable. In this regard the electric release of the present security door assembly has two features which are particularly advantageous.

Firstly, the electric release 44 is only operated when the handle 20 is rotated by 90 degrees and so the battery life is conserved compared to a lock where the power is permanently supplied. This works by a microswitch which is switched to complete the power circuit of the electric lock when the espagnolette 30 moves to its intermediate position. An opening in the espagnolette is provided which is aligned with the switching member of the microswitch when either the espagnolette is in its initial position or its intermediate position, which causes movement of the switching member when the espagnolette 30 changes position.

Secondly, the electric release in the illustrated embodiment has a special mounting arrangement. The mounting arrangement provides an electrical connection from the exterior surface of the door 12 to the power supply circuit of the electric release 44. This will normally be disguised as a security bolt fixture on the finger pad 19 on the exterior of the door panel 14.

In circumstances where the security doors assemblies 10 are fitted across all the entrances into flats in a block of flats, regular checks need to be made of the condition of the battery 48 in each door, because often these doors are in situ for a number of months. Checks of this nature make it unlikely that one of the doors will fail because the battery 48 has not been changed, but are time consuming and often neglected. The present arrangement could further include means to allow the batteries 48 to be checked when the door is still locked via the electrical connection from the exterior of the door 12, thus making the checking procedure more efficient.

The external connections provided on the door 12 enable separate external power supply apparatus 42 can be used to power the electric release 44 from the exterior of the door 12. Therefore, in circumstances when the battery 48 does fail and the door is locked, it is still possible to open the door if one has the necessary external powering apparatus 42. This apparatus would comprise two probes 42 spaced so as to engage the connections provided on the finger pad 19. The probes would be mounted on a housing and connected to a suitable power source, such as a battery. Normally, a switch would be included in this circuit so that the connections to the probe 42 is only completed when the switch completes the circuit.

A further possibility (not illustrated) with such an external power supply would be to remove the internal power supply 48 so that the electric release 44 is inoperable unless a person trying to gain entry through the door 12 has a suitable external power supply apparatus. This would further deter unauthorised entry through the security door.

Often a battery tester and power pack could be combined in a single apparatus. The battery testing circuit can be integral with an external power supply apparatus, or may be a separate circuit as shown in the accompanying drawings. For external use the battery testing circuit may be connected to the probes 42, which would be connected to an ammeter, a voltmeter, or other means for measuring the state of any internal battery 48. Alternatively, or additionally, another connection can be included for the connection to the internal battery connection for testing the battery if the security door apparatus is unlocked.

In the illustrated embodiment, the electric release has its microswitch keypad 45 located on the interior of the door panel 14, which offers greater security than mounting it on the exterior surface of the door because it is far more difficult to damage the keypad 45. Of course, a customer could specify that the security door apparatus has an externally mounted key pad if this was a customer requirement.

The mortice lock 40 in the illustrated embodiment is advantageous compared to the mortice locks used on previously known security door assemblies because the keyhole 43 is not accessible to unauthorised users and the forcing of the mortice lock 40 does not result in the immediate unlocking of the security door assembly.

In view of the advantages mentioned above, the mortice lock 40 may use a standard barrel, a so-called Euro-cylinder. Previously special cylinders had to be used by the manufacturers of the door assemblies in order to provide reasonable security because of the problems with picking the lock, vandalism or the availability of master keys.

As the mortice lock of the security door assembly 10 does not form the primary lock mechanism, the mortice lock 40 does not have to offer as great a resistance to being forced compared to situations where the mortice lock is the primary locking mechanism. The force limiter 23 associated with the espagnolette 30 also reduces the resistance requirement for the mortice lock 40.

The use of such standard mortice locks not only reduces the manufacturing costs, but also increases the security because of the vast degree of different barrels designs which are available. Furthermore, the use of master keys reduces the problem of an installation team requiring a very large number of individual keys. The use of such standard locks also allows the customer to specify the types of locks used and also provides the possibility that when the assembly is moved between installations, the mortice lock key cylinder can just be replaced by a new cylinder so a different user is secure and avoids the problem of immediately requiring the return of all previously issued keys. Of course, the previously known mortise locks could be used in conjunction with the security door apparatus of the present invention.

The location of the keyhole 43 of the mortise lock 40 prevents an authorised user from being locked into the dwelling by leaving the key to the mortise lock 40 in the keyhole 43 after entry into the dwelling. This occurs in previously known security door assemblies, especially when workmen or other authorised users carrying large amounts of equipment use the security door assemblies. If the authorised user is locked into the dwelling in this manner, the authorised user will not be able to leave the dwelling because all other possible exits to the dwelling will also have been secured. The possibility of such a lock in occurring because the handle 20 must be moved from its intermediate position to the 180 degree position in order to release the espagnolette locking mechanism, which means the handle 20 has to be moved over the keyhole 43 to open the door 12. Consequently, the key has to be removed from the keyhole 43 to open the door 12. Please note that this also reduces the possibility that an authorised user leaves the key in the mortise lock 40 when exiting the dwelling because the key must be moved to reset the handle 20.

If it is desired to further secure the hinged side of the door, it would be possible to fit the hinged side of the door with an espagnolette/cam locking mechanism (not shown) generally similar to the one on the handle 20 edge of the door. For example, the second espagnolette could be rigidly linked to the espagnolette 30 by tie bars across the inner surface of the door panel 14. The second espagnolette would have similar slots with widened slot sections. The inner surface of the door frame 60 on the hinge side would be fitted with second cams which could fit through the widened slot sections of the second espagnolette when the espagnolette 30 was in the unlocked position. The second cams, of course, slide in the slots of the second espagnolette, but are not movable therethrough when the espagnolette 30 is not in the unlocked position. Other securing means, possibly linked to the locking mechanism associated with the handle 20, could also be utilised.

In the above described locking mechanisms for the security door apparatus of the present inventions, it is clear that any one of the various locks bolts and latches could be either replaced by another standard type of lock, or could be dispensed with depending on the level of security required by the customer.

Furthermore, more than one of the locking mechanism could be fitted to any particular door if this was considered to be necessary.

Security door assemblies are often used when buildings are being renovated, etc. In such circumstances, an authorised workman may enter the building by opening the locking mechanism on the door, but there was no satisfactory provision for the door to be unlocked from inside of the dwelling. It is therefore possible that a workman may become locked inside the dwelling if another person locks the door from the outside.

The illustrated security door arrangement provides a lock-in prevention latch 50 to overcome this problem. The lock-in prevention latch 50 prevents the door from being re-locked unless the lock-in prevention latch 50 is actively reset from the interior side of the door assembly 10. This prevents authorised users from accidentally locking a colleague within a dwelling and also cause the unauthorised user to be unable to lock the door assembly 10.

As illustrated best in FIGS. 17 to 22, the lock-in prevention latch 50 has a latch bolt 51 which is biased to latch the espagnolette 30 when the espagnolette 30 enters the open position, thus barring further movement of the espagnolette 30 until the latch 50 is reset.

As described above the espagnolette 30 comprises a U-shaped member with the open end opening towards the door panel 14 within the U-shaped channel 17. Each of the side sections 36, 37 of the espagnolette 30 include a lock-in prevention latch openings 53, 54 (respectively) through which the latch bolt 51 extends to latch the espagnolette 30.

The lock-in prevention latch 50 maintains an initial position shown in FIGS. 18 and **22*b* when the espagnolette 30 is not in the unlocked position. The latch bolt 51 extends through opening 53 in the side section 36 and is biased against the side member 37 as the latch bolt is not aligned with the opening 54 in the side member 37. The latch bolt 51 is biased by means of latch spring 55 acting via the catch member 52 and associated pivot. In this initial position, the espagnolette 30** is free to move between its locked and unlocked positions.

When the espagnolette 30 reaches its unlocked position, the latch bolt 51 is aligned with the hole 54 in the side member 37 and so the latch spring 55 fires the latch bolt 51 through the opening 54 to a latched position shown in FIGS. 19 and 22*c* where the end of the latch bolt 51 extends through an associated opening in the face of the U-shaped channel 17. In the latched position, the espagnolette 30 is thus prevented from moving from its unlocked position and prevents an accidental lock-in.

In order to unlatch the espagnolette 30 so that the door can be locked, the latch bolt 51 is pulled against the spring biasing (right in FIGS. 17 to 21) through the position shown in FIGS. 21 and 22*e* and moved to a set position shown in FIGS. 17 and 22*a*. The catch member 52 prevents the spring 55 firing the latch bolt 51 through the opening 54 due to the engagement of a catch portion 56 acting against the side section 36 immediately above the opening 53.

The spring 55 acts on the catch member 52 in such a manner as to impart a turning force on the catch member 52 in the direction to raise the catch portion 56 as well as to impart the aforementioned horizontal spring biasing on the latch bolt 51.

The latch bolt 51 is pulled against the spring biasing through the opening 53 during the unlatching procedure to a position where the catch portion 56 is outside the espagnolette 30. The turning force on the catch member 52 turns about the pivot. When the latch bolt 51 is released the spring biasing moves the latch bolt 51 towards the opening 54 until this motion is stopped due to engagement of the catch portion 56 with the side member 36, as shown in FIGS. 17 and 22*a*. In the set position of the latch 50, the main lock of door assembly 10 can be re-locked.

When the main lock of the door assembly 10 is now moved to its locked position whilst the latch 50 is in the set position, the espagnolette 30 moves upwards and the catch portion 56 disengages with the side member 36. The latch bolt 51 is moved by the spring biasing into the position shown in FIGS. 18 and 22*b* where the latch bolt abuts the side member 37 because the opening 54 is not in alignment with the latch bolt 51 due to movement of the espagnolette 30.

It is often desirable to prevent entry into a dwelling when a person is already inside, for example where the person is in a room remote from the door. This prevents thieves (or anyone else) entering without disturbing the person inside. In order to facilitate such closing of the door, the door assembly 10 has a third position of the lock-in prevention latch 50, as shown in FIG. 19.

The lock-in prevention latch 50 is housed in a housing 57. The catch member 52 has a flange element 58 which extends through an opening 57*a* in the housing 57. The opening 57*a* in the housing 57 is designed so that the flange portion 58 abuts a first stop-side thereof when the latch bolt 51 extends through the side section 37 less than the distance to the door frame side member 63. The door 12 can be moved hingedly in this position to facilitate entry and exit from the dwelling.

The door frame side member 63 has an opening 63*a* similar in size to the opening 54 aligned therewith so that the latch bolt could extend into the opening 63*a* in the side member 63 if flange portion 58 was not held against further movement towards the side member 63. The opening 57*a* in the housing 57 has an extension in the direction towards the side member 63 immediately above the first stop-side of the housing 57.

The spring 55 acts on the catch member 52 to turn the flange portion 58 into engagement with the first stop-side of the housing 57. This reliably prevents the latch bolt 51 from immediately entering the opening in the side member 63 when the espagnolette 30 is moved to the unlocked position.

The flange member 58 can be disengaged with the first stop-side of the housing 57 and the latch bolt moved through the opening in the door frame side member 63 to prevent the door 12 being opened from the exterior thereof.

In embodiments of the security door assembly not using espagnolette locking means as the primary lock mechanism the lock-in prevention latch could still be utilised. For example, if the primary locking mechanism was a mortise lock, the lock could operate as follows. The latch bolt could actually form a cam surface and the movement of the bolt would raise or lower a blocking plate. The blocking plate would have an opening sized to just accommodate the bolt of the mortise lock. The lock-in prevention device would be biased to move the blocking plate so that a socket into which the mortise bolt locked was covered by the blocking plate. Thus, as soon as the bolt is moved from the socket, the assembly could not be re-locked without re-setting the lock-in prevention device. The lock-in prevention device would be set in a similar manner to the illustrated device, except that the stop against which the catch portion acts could be movable to release the lock-in prevention device to its initial position ready to block the socket. For example the stop may be biased upwards against the mortise lock bolt such that movement of the bolt out of the unlocked position raises the stop. Of course, in the set position and the initial position, the opening in the blocking plate allows movement of the bolt into the socket.

Other types of lock-in prevention latches could also be used. The other types of latch would, in a first position, prevent a primary locking mechanism moving from its unlocked position towards it locked position. The lock-in prevention latch would also have a further position where movement of the door 12 in the frame 60 is prevented whilst the primary lock is in its unlocked position. The lock-in prevention latch must be only user operable from the inside of the door and the further position must only be entered by user choice.

The security door assembly 10 is normally made from pressed steel. The main door panel 14 is made from a sheet of steel which fits within the door frame 60.

The above-described the door frame 60 is made from pressed steel sections. The hinges 15 are located on the exterior surface of the door frame hinge side member 61 and comprise the normal drop-in type. This is to allow easy removal of the door when in the open position so that the frame can be fitted to the doorway without the weight of the door ready inserted. Once the door is in the closed position it is not possible to lift the door off of its hinges and so the external mounting of the hinges does not detract from the security aspects of the door.

Figure 23:
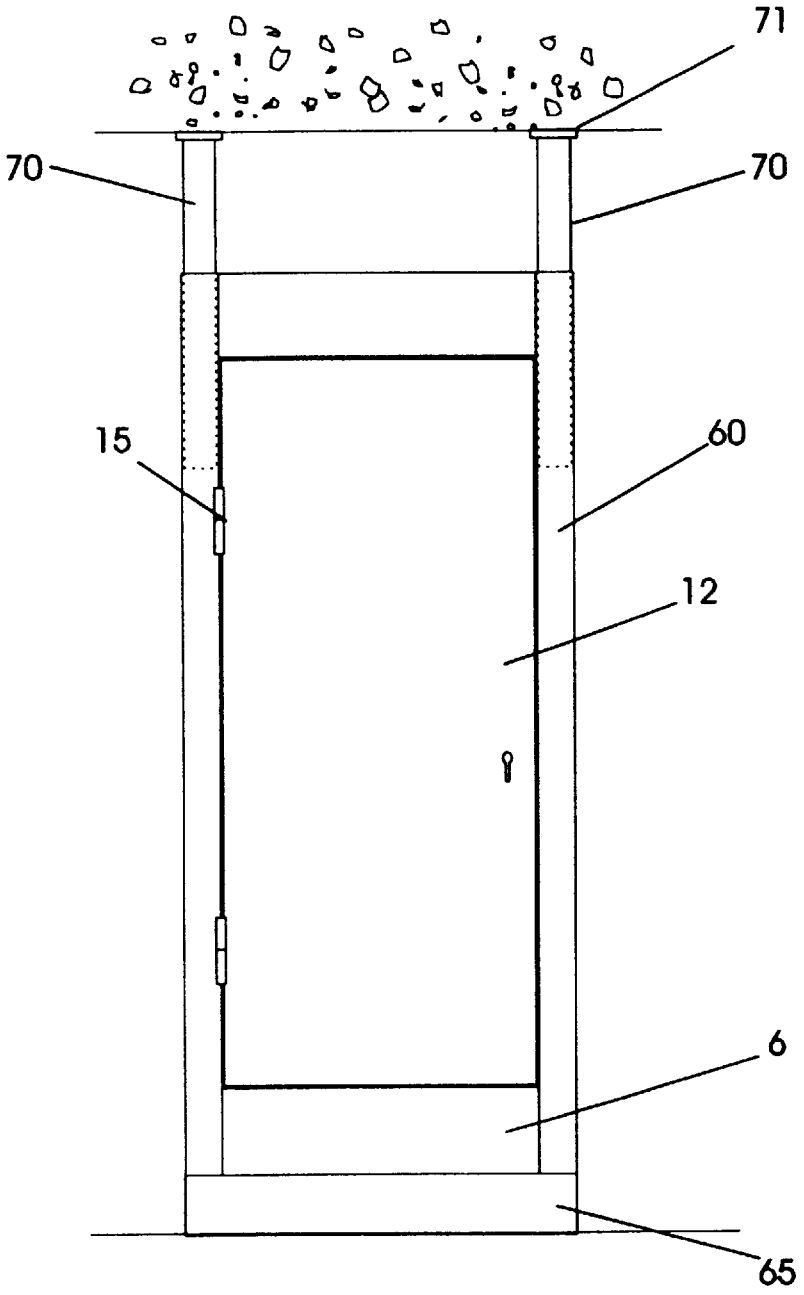
FIG. 23 shows a schematic front view of the door assembly fitted into the entrance of a dwelling.
Figure 24:
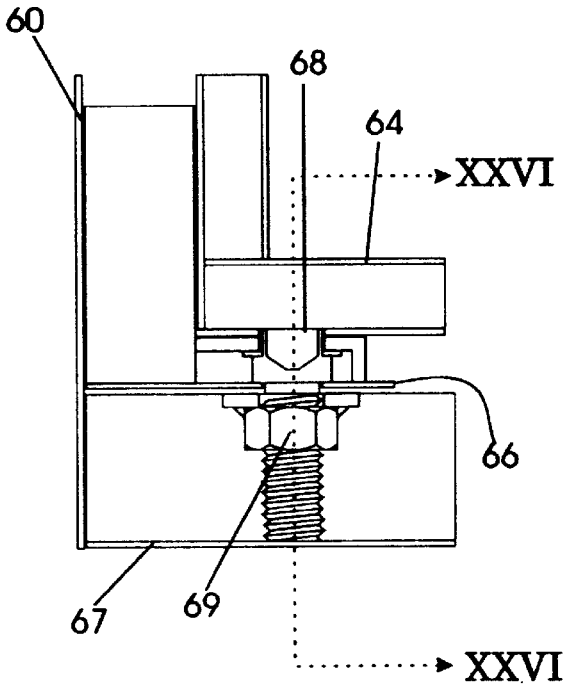
FIG. 24 shows the lower mounting mechanism of the door assembly of FIG. 23 in a first position.
Figure 25:
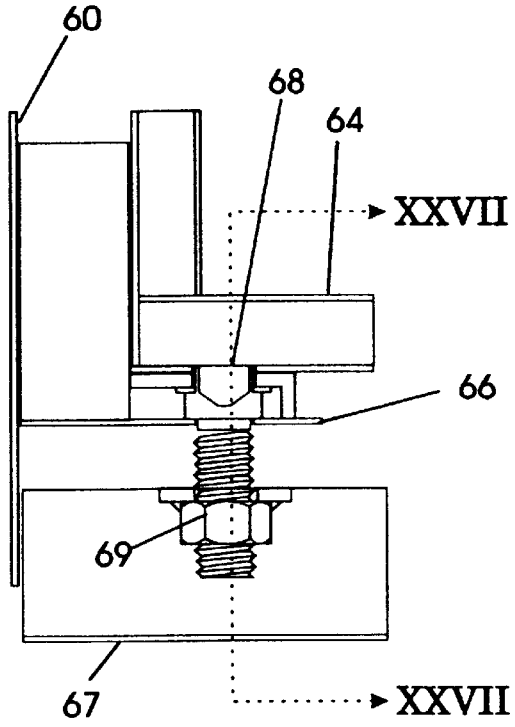
FIG. 25 shows the lower mounting mechanism of FIG. 24 in a second position.
Figure 26:
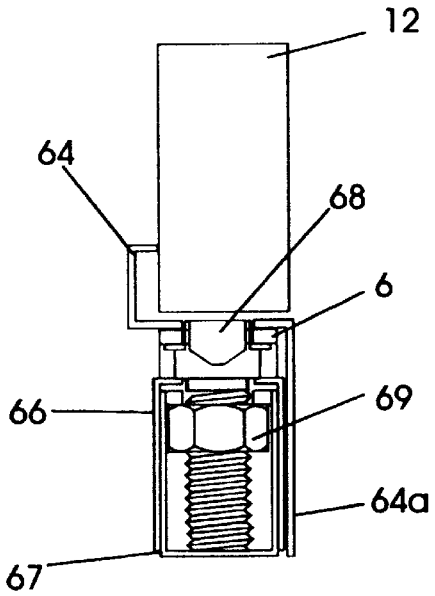
FIG. 26 shows a sectional view along the line XXVI—XXVI of FIG. 24.
Figure 27:
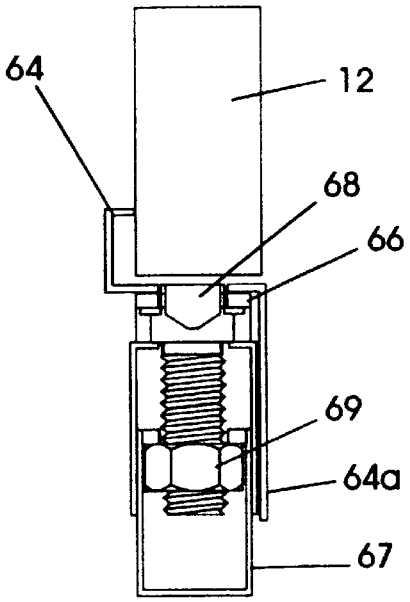
FIG. 27 shows a sectional view along the lines XXVII—XXVII of FIG. 25.

As illustrated in FIG. 23, the door frame 60 is braced in the doorway by firstly extending telescopic legs 70 fitted to extend from the top of the door frame 60 to abut the soffit to loosely hold the door assembly 10 in the entrance. Then the door assembly 10 is tightly braced in the entrance by expanding an expanding threshold 65 fitted into the bottom member 64 of the door frame 60.

The expanding threshold device 65, shown in FIGS. 24 to 27, comprises a U-shaped upper member 66 which has the open side of the upper member 66 facing downwardly and a U-shaped lower member 67 which has the open side of the lower member 67 facing upwardly fitted within the upper member 66. The upper member 66 is restrained from vertical movement by the bottom door frame member 64. The upper member 66 has a bolt member 68 extending through the upper surface of the upper member 66 vertically into the lower member 67. The bolt member 68 is fixed against vertical movement but is free to rotate about an axis along the longitudinal axis of the bolt member 68. A nut member 69 is mounted vertically and rotationally fixed in the lower member 67.

The vertical extent of the expanding threshold 65 depends on the overlap between the upper and lower members 66, 67. The overlap can be varied by rotating the bolt member 68. The bolt member 68 is normally an Allen bolt or a security bolt, with the head thereof accessible through an opening in the bottom frame member 64 of the door frame 60. The bottom frame member 64 includes a plate 64*a* depending downwardly in the exterior plane of the door frame 60. This downwardly depending plate extends to cover the expanding threshold 65 when set to its minimum vertical extent.

The nut and bolt arrangement in the expanding threshold device could of course be varied so that the nut is mounted rotatably on the upper member and the bolt is fixed in the lower member. Other height varying means could also be used.

The telescopic legs 70 used with the security door assembly 10 are illustrated in FIGS. 28 to 31 and are provided with infinite vertical adjustment between predetermined limits. This is particularly advantageous because it allows the door frame 60 to be loosely braced in the entrance before expanding the bottom threshold 65.

Each telescopic leg 70 comprises a hollow tube 71 with a leg member 74 mounted internally thereof and slidable therein. The tube 71 is fitted into the top of the door frame 60 to extend upwardly from the corners of the door frame 60 and brace against the lintel/soffit above the door assembly 10. The tube 71 forms a protective sheath for the leg member 74 which comprises a solid bar.

The leg member 74 extends from the tube 71 to a bracing plate 75. When the hollow tube 71 is inserted into the top of the door frame 60 the leg member 74 extends further inwardly thereof. The hollow tube 71 is pushed downwardly until the bracing plate 75 abuts a leg member stop 73 mounted within the door frame side member 61, 63.

A retaining hole 72 is provided in the side member 61, 63 in an area which is not accessible from either the interior or exterior of the door assembly 10 when the door 12 is closed. The retaining hole 72 is located just above the internally mounted leg stop 73 in the door frame side member 61, 63.

When the telescopic leg 70 requires expansion, a bracing tool is inserted into the retaining hole 72 to prevent movement of the leg member away from the leg stop 73 of the door frame 60. The leg member 74 is mounted within the hollow tube 71 such that it can be withdrawn therefrom in the direction to increase the total length of the telescopic leg 70, but is restrained from movement to decrease said total length by holding device 76.

In the illustrated embodiment, the holding device 76 comprises two plates 78, 79 mounted across the hollow tube 71. The fixed plate 78 has a hole 78*a* through which the leg member 74 extends. The hole 78*a* in the fixed plate 78 is sized to correspond to the external diameter of the leg member 74. This fixed plate 78 is fixed and the telescopic leg extends perpendicularly therefrom. A moving plate 79 is mounted extending across the hollow tube 71 and has similar hole 79*a* to the fixed plate hole 78*a* through which moving plate hole 79*a* the leg member 74 extends. The moving plate 79 is mounted in a hinged or tilting manner and is biased so that the moving plate 79 is not parallel to the fixed plate 78 and so that one side of the hole 79*a* abuts the leg member 74 extending therethrough. Movement of the leg member 74 to extend the total length causes frictional engagement between the leg member 74 and the moving plate 79. Such frictional engagement acts against the biasing force to bring the moving plate 79 into an aligned position where the moving plate hole 79*a* is so aligned with the fixed plate hole 78*a* that the leg member 74 slides through the holding device 76.

The biasing force is supplied by a spring 77 mounted between the plates 78, 79. The moving plate 79 is mounted further inside the hollow tube 71 compared to the fixed plate 78 in the direction away from the bracing plate 75. One side of the moving plate 79 is fitted into a recess 81 formed in the hollow tube 71 with the approximate dimensions of the moving plate 79. The other side of the moving plate 79 is not tightly held and abuts a stop 82 further along the hollow tube 71 in the direction away from the bracing plate 75. The stop 82 comprises a stop plate 82 similar to the fixed plate 78.

Normally, the total length of the telescopic leg 70 can be reduced by pushing on the bracing plate 75 end of the leg member 74 with the release bar 84 integral with the leg member 74 when downward pressure is exerted on the movable plate 79. Normally, the telescopic leg 70 cannot be shortened until the bracing pressure is removed from the door assembly 10.

The spring bias used to bias the moving plate 79 is quite small, but is sufficient to hold the hollow tube 71 from sliding back down the leg member 74 under its own weight. This allows the door frame 60 to be mounted in the entrance and loosely braced by means of these variably adjustable telescopic legs 70. When the expandable threshold 65 on the bottom of the door frame is expanded this puts the whole door frame 60 under bracing pressure. This bracing pressure increases the frictional engagement between the moving plate 79 and the leg, to make it extremely difficult to cause collapse of the telescopic leg 70. As the telescopic leg 70 is variably adjustable the amount of expansion required from the expandable threshold 65 is very limited. This provides an extremely secure bracing of the door frame 60 in the entrance.

Figure 31:
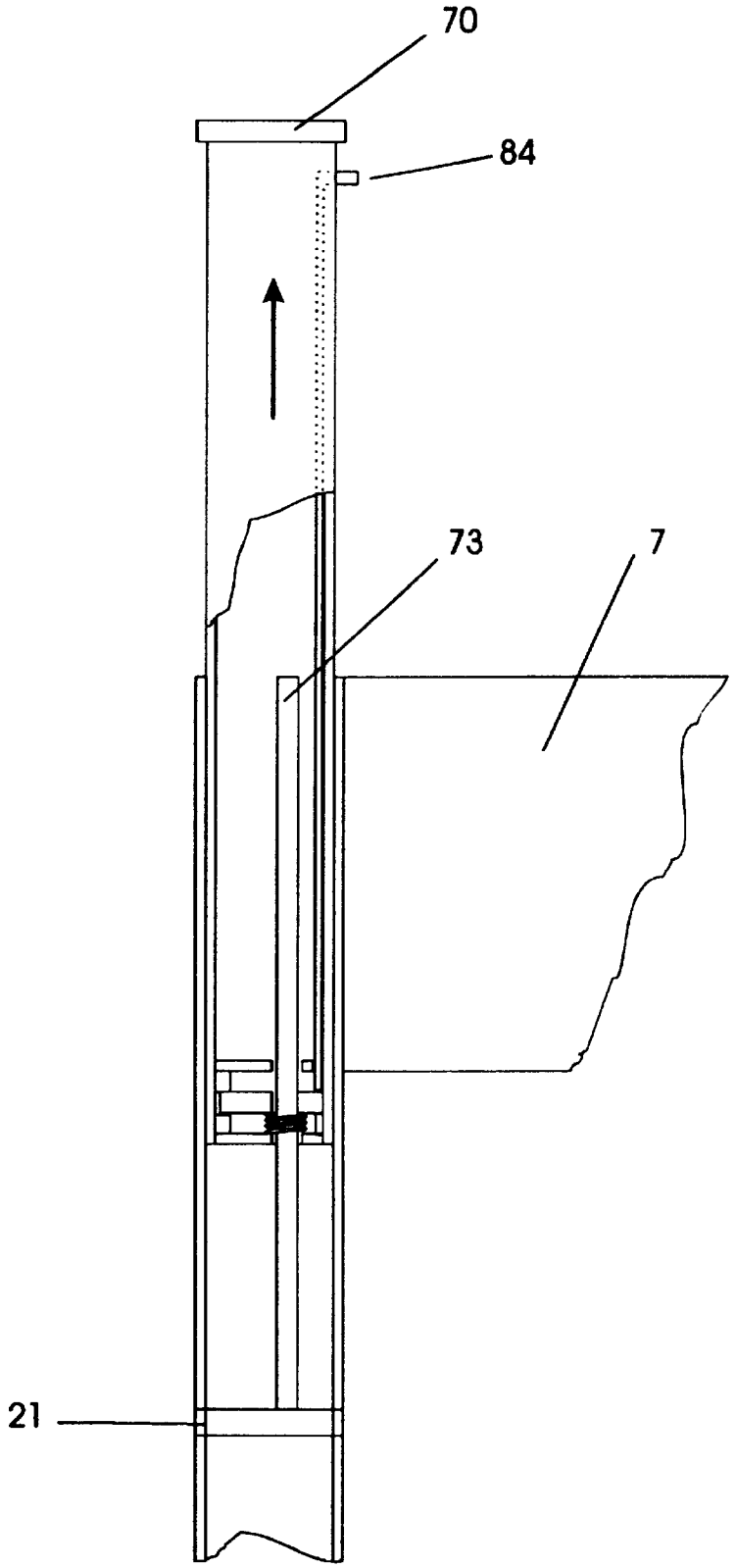
FIG. 31 shows a partly sectional view of a top mounting means for FIG. 23.

In the embodiment of FIG. 31, a release bar 84 may be mounted in the hollow tube 71 in a manner to allow pressure to be applied to the moving plate 79 against the spring biasing to allow an operator to release the leg member 74 in order to decrease the total length of the telescopic leg 70. The release bar 84 is designed so that the maximum pressure which can be applied through the release bar 84 before the release bar 84 buckles is less than the force required to move the moving plate 79 when the expanding threshold 65 has been expanded. This prevents the accidental decrease in length of the telescopic legs 70 when the door assembly 10 has been installed. In this embodiment the leg member 74 is fixed into the door frame 60 and extends upwardly therefrom. The hollow tube 71 is then inserted onto the leg member 74 to slide thereupon. The total length of the telescopic leg 70 is still variable in the same manner as the embodiment of FIG. 29. Alternatively, the operating means for the release bar could be disguised or hidden. Another alternative would be to provide another mechanism for releasing the moving plate.

In this application references have been made to vertical and horizontal distances and directions. These references should not be construed as being absolute. In this application vertical means in the direction of the door frame side members longest extent. The exterior of the door refers to the side with the handle is mounted. Terms such as inwards/outwards, inside/outside, upwardly/downwardly and horizontal are all used in agreement with the meanings defined above. It should be noted that in many instances the absolute directions could be varied.

It should be noted that the following four examples relate to features of the above described door assembly which have specific advantages with independent utility.

EXAMPLE 1

The present example relates to a more secure door assembly and in particular a locking mechanism for a door assembly.

According to the present example there is provided a locking mechanism for a door assembly comprising a main locking mechanism movable between a locked position and unlocked position through an intermediate position, a secondary lock being provided which secondary lock in a first position prevents the main locking mechanism moving to the unlocked position and in a second position allows the main lock to move to the unlocked position and wherein the secondary lock is only movable to the second position when the main locking mechanism is in the intermediate position.

Advantageously, the present example thus provides extra security due to the requirement to unlock the secondary lock before the main door lock can be unlocked thus providing a double level of security. The requirement that the secondary lock is only operable when the main locking mechanism is in its intermediate position further increases security.

In a preferred embodiment, the main lock is operable by movement of a handle and further wherein the secondary lock either comprises:

(i) a mortise lock the keyhole of which is covered by the handle when the main lock is in the locked position and the handle moves to expose the keyhole when the main lock is moved to the intermediate position; or (ii) an electric release in which the power circuit is broken when the main lock is in the locked position and completed by a switch switched by the handle when the main lock is moved to the intermediate position.

The handle of the main lock thus disguises the presence of the secondary lock and its operation.

Advantageously, the locking mechanism further incorporates a latch mechanism where either the latch mechanism comprises the secondary lock, or the latch mechanism comprises an additional lock, wherein the latch mechanism in a restraining position prevents movement of the main locking mechanism from the locked position to the intermediate position, and in a release position allows movement of the main locking mechanism into the intermediate position.

In particular, embodiments of Example 1 may provide the following additional advantageous features: a) The locking as set out above further including a force limiter to limit the force applicable to the secondary lock by the main lock; b) The force limiter may comprise a lost motion means associated with the movement of the handle; c) The main lock may be prevented from moving to the intermediate position until a latch is released; d) It may further include a latch mechanism comprising the secondary lock, wherein the latch mechanism in a restraining position prevents movement of the main locking mechanism from the locked position to the intermediate position, and in a release position allows movement of the main locking mechanism into the intermediate position; e) The latch comprises a restraining plate mounted on the door slidable between a restraining position and a release position by movement of a keyhole plate mounted on the exterior of the door, the latch being biased into the restraining position; f) Movement of the restraining plate from the restraining position to the release position is prevented by a latch member in a first position into which it is biased, the latch member being movable into a second position to allow the movement of the restraining member; g) The latch member comprises a spring finger mounted between the door and the restraining member, or locking screw; and h) The restraining plate is only movable when a locking screw has been removed.

EXAMPLE 2

The present example relates to a lock-in prevention latch for a door assembly particularly, but not exclusively, to a security door assembly which is fitted temporarily on a building.

However, the door assemblies only have operating means for the locks or locks on the outside of the door. This can cause a problem when a person checks the state of the security doors within a building and secures any unlocked doors. Sometimes another authorised person may be within a dwelling locked by the person checking the door and thus become trapped in the dwelling. Unfortunately, this problem is exaggerated because miscreants sometimes wander through a building having security doors with the intent of locking authorised users inside the dwellings.

The present example seeks to provide a door assembly where lock-in of an authorised person is prevented.

According to the present example there is provided a lock-in prevention latch for a door assembly having a lock which lock is only operable from an exterior side of the door, the latch being operable from the interior side of the door and comprising a latch bolt biased from an initial position to a latched position in which the latch prevents movement of said lock into its locking position, the latch being movable to a set position where the lock is movable into its locking position, wherein the latch bolt moves to the latched position when the lock moves out of its locked position and the latch bolt moves from the set position to the initial position when the lock moves from its unlocked position.

Thus the door is automatically prevented from being re-locked as soon as it is unlocked and can only be re-locked when actively reset. This will prevent accidental locking-in of a person inside a building. This will also lessen the intentional locking-in of a person within the building by the miscreant who is unlikely to realise that the lock-in prevention latch requires resetting.

Preferably, the latch bolt has a further position in which the door is prevented from hinged movement by the latch bolt and the lock is prevented from moving from its unlocked position. When a authorised user is within a building secured by the door assembly, the user is often distant from the door, possibly in another room. As the doors were not formally secured from inside, thieves sometimes sneak through the unlocked door to steal tools, etc. The present further position of the lock-in prevention latch prevents thieves from being able to sneak through the door.

When using a latch with such a further position, normally a catch member is biased against a catch by the turning force when the latch bolt is in the latched position, thus stopping movement of the latch bolt to the further position, the latch member being engagable from the catch. This prevents the door from becoming latched closed as soon as it is unlocked, which would clearly be undesirable.

The particular embodiments of Example 2 may further include advantageous features. In the locking mechanism, the catch means catches against a stop to hold the latch in the set position, a spring acting on the catch means biasing the latch bolt from the set position to the initial position and from the initial position to the latched position. The catch means can comprise a catch member pivotably mounted on the latch bolt with the spring providing a force to turn the catch member towards the stop as well as to bias the latch bolt. The stop can move to disengage the catch member when said lock moves from the unlocked position.

In a door assembly including a door frame, a door may be hingedly mounted in the door frame and lockable in the door frame by a lock operable only from an exterior side of the door. A lock-in prevention latch can be provided, the latch being operable from an interior surface of the door and being biased to prevent movement of the lock to its locking position and the latch being movable to a further position in which the door is prevented from movement when the lock is in its unlocked position. The latch bolt may have a further position in which the door is prevented from hinged movement by the latch bolt and the lock is prevented from moving from its unlocked position. The catch member may be biased against a catch by the turning force when the latch bolt is in the latched position, thus stopping movement of the latch bolt to the further position, the latch member being engagable from the catch.

EXAMPLE 3

The present example relates to a door assembly, and an electric release for fitting to the door assembly particularly, but not exclusively, to a security door assembly which is fitted temporarily on a building.

According to the present example there is provided an electric release adopted to be fitted to a temporary door assembly, the electric release being adapted to prevent movement to an unlocked position of a main lock mechanism, for example an espagnolette lock, in a closed position of the electric release and to permit said movement in an open position of the electric release, the electric release is battery powered and the lock is operable through a microswitch key pad located on the interior side of a door, wherein the microswitch keypad is switchable by actuating elements extending through the door, the actuating bars being actuated by depression of a finger pad located on the exterior of the door.

Advantageously, the present example thus provides extra security due to the requirement to unlock the electric release before the main door located can be unlocked thus providing a double level of security. As the electronic release is only operable through a microswitch key pad located on the interior side of a door and thus the relatively fragile microswitch keypad is protected by the door. As the interior mounted microswitch keypad is switchable by actuating elements, for example nylon ball bearings or actuating bars, extending through the door, the actuating bars being actuated by depression of a finger pad located on the exterior of the door. The movement of the fingerpad is limited by the door, thereby limiting the force exertable on the microswitch keypad by the actuating. This further prevents the likelihood of damage to the electric release. Furthermore, the fingerpad can be disguised as a house number plate to provide even greater security.

The electric release is usually provided with a power circuit switchable between an off state where the electric release is not operable and an on state where the electric release is powered. Advantageously, the power circuit is normally in the off state and a further mechanism is operated to move the power circuit to the on state normally for a limited time as this preserves battery life.

The further mechanism can comprise a switch connected to the main lock operating mechanism, for example a handle of an espagnolette lock, the switch being actuated when the main lock operating mechanism is in an intermediate position between the main lock locking and unlocking positions. Often the further mechanism is prevented from entering the intermediate position until a latch is undone. In circumstances when the fingerpad is disguised, often an unauthorised person will not realise that the door is fitted with an electric release.

Power connections may be provided to enable a power supply to be connected from the external side of the door. This feature has particular independent utility in all electric locks fitted to temporary installations.

Additionally, or alternatively, power connections may be provided to enable the condition of a power supply battery mounted inside the door to be checked from outside of the door. Electric releases had previously not been used with security door assembly due to the fact that if the battery expired when the door was locked the building could not be entered even by authorised people without major damage to the door assembly or building. This was a particular problem where the door assemblies were fitted temporarily for a period of several months, but were irregularly operated. The power connections may be disguised on the exterior surface of the door, for example being covered by or taking the form of security bolts.

Preferably, a force limiting device is included to limit the force applicable to the electric release catch mechanism in from the main lock, for example lost motion device fitted to the operating handle of an espagnolette lock. Another reason battery powered electric releases had not been used previously was due to the fact that electric releases do not use strong latches because of the power required to operate such a strong latch. As the security door assemblies to which the present example is particularly applicable are temporary fixings to a building in which often the main electrical supply has been disconnected it is normally impossible to provide permanent electrical power to the door assembly.

The above features make it particularly practical to use electric releases in security door assemblies.

EXAMPLE 4

The present example relates to a door frame assembly with a telescopic leg for mounting in a door frame assembly and/or an expanding threshold for the door frame assembly, particularly, but not exclusively, to a security door assembly which is fitted temporarily on a building.

The known door assemblies are braced into the existing doorway of the building between the soffit and the threshold. The known assemblies use a telescopic leg to extend from the top of the door frame to the soffit. Such telescopic legs comprise a tube and a leg member in which the leg is fixed in the tube by a bar pushed through holes in the tube and holes in the leg member. The leg member is provided with a series of such holes in order to vary the length of the known leg. The bar/hole arrangement is hidden when the leg is inserted into the door frame in order to prevent collapse of the legs when the door is in situ.

At the bottom of the known assemblies an extending leg extends from the bottom frame member of the door frame.

Normally, this is located behind a flange of the bottom frame member, which flange extends down as far as the minimum height of the expanding leg to protect the leg from interference when the door assembly is mounted.

To brace the door, the door frame assembly is rested in the door way and the telescopic leg extended to what is guessed to be a suitable distance and then fitted in to the doorway. The door is stood upright and the bottom legs are then expanded from their minimum length until the frame is tightly braced.

The fixing of a security door assembly in the door way is a limiting factor in the security of the door and so the fixing should be as secure as possible whilst being simple to install. The present example seeks to provide a more secure fixing of a door frame in a doorway.

According to a first aspect of the present example there is provided a telescopic leg adapted to extend, in use, from a door frame, the leg comprising a tube with a leg member extending from an open end thereof and a gripping means for holding the leg member in the tube, wherein the gripping means in a gripping position allows extension movement of the leg to extend further from the open end of the tube and prevents decreasing movement of the leg member to extend less from the tube, said decreasing movement only being possible when the telescopic leg is not in the door frame.

The telescopic leg of the present example has the advantage that the length of the leg can be varied when fitted into the door frame and so the assembly can be loosely braced in the door way by merely extending the telescopic legs. This also means that less expansion is required from the bottom of the assembly, leaving the bottom of the assembly less prone to attack.

According to a preferred design of the telescopic leg, the gripping means comprises a fixed plate and a movable plate both of which are mounted across the tube, the leg member extends through an opening in each plate and, the moving plate is biased to a position where the edge of the movable plate frictionally engages the leg member, the biasing force being in the direction of the decreasing movement. The movable plate is tiltingly mounted further from said open end than the fixed plate, and the biasing force is provided by a compression spring mounted between the plates which applies the biasing force to the edge of the movable plate distant from the hinge mounting. This design has the advantage of offering a mechanically simple way of providing the continuous telescopic leg adjustment. Additionally, this design has the advantage that whilst the telescopic leg can be extended to loosely brace the assembly in the doorway, the strength of the frictional engagement increases when the bottom of the assembly is expanded, thus making the overall assembly more secure.

Whilst the above telescopic legs of the present example makes the normal extending legs of the bottom assembly less vulnerable to attack, preferably there is provided an expandable threshold according to a second aspect of the present example. The height of the expandable threshold is determined by the distance between an upper surface of a upper member and a lower surface of a lower member which members are connected together by connection means in a manner in which the height is set between maximum and minimum settings, wherein each of the members has a side section which side sections overlap with one another in all height settings of the threshold. Optionally, the height threshold is continuously variable between the maximum and minimum settings. The overlapping side sections means provide the expansion means, for example the nut and bolt arrangement, is protected from interference whatever the height setting of the threshold.

Particular features which may be incorporated in embodiments of this example are:

a) the gripping means comprises a fixed plate and a movable plate both of which are mounted across the tube, the leg member extending through an opening in each plate, the movable plate being biased to a position where the edge of the movable plate frictionally engages the leg member, the biasing force being in the direction of the decreasing movement;

b) the movable plate is hingedly mounted further from said open end than the fixed plate, and the biasing force is provided by a spring e.g. a compression spring mounted between the plates which applies the biasing force to the edge of the movable plate distant from the mounting about which the movable plate tilts;

c) providing means for moving the gripping means to a non-gripping position where the leg member is not prevented from said decreasing movement;

d) the means for moving the gripping means either includes (i) the leg member, or (ii) a release member which extends from the edge of the movable plate on which the spring acts on the side opposite the fixed plate to an actuation section from where the release bar can be actuated to counter the biasing force;

e) the movable plate is only movable to its non-gripping position when the telescopic leg is not braced;

f) the tube is sized to be slidably mounted in an opening in the door frame with the leg member extending further thereinto;

g) either (i) the leg member extends to a biasing plate which is adapted to abut a stop in the door frame when mounted; or (ii) the leg member is fixed to a stop in the door frame and the tube is mountable thereonto;

h) the expandable threshold includes a nut element mounted on one of said members and a bolt element is mounted on the other of said members, where the element mounted on the upper member is rotatable and accessible through an opening formed in a bottom member of the door frame;

i) the height adjustment of the expandable threshold is effectuated by at least one hydraulic jack.

Of course, features of the above examples relate to advantages of the present invention as well as being independently advantageous features.

What is claimed and desired to be secured by Letters Patent of the United States is:

1. A locking mechanism comprising a locking member movable between a locking state and non-locking state, a lock releasably engagable with the locking member to prevent the locking member moving to the non-locking state, and an operating means coupled to the locking member by connecting means which includes a force limiter, which force limiter limits the force the operating means can apply to the locking member without damage to any of the parts of the locking mechanism wherein the operating means is movable to an intermediate position before the lock prevents further movement of the locking member and the lock is only releasable from engagement with the locking member when the operating means is in the intermediate position.

2. The locking mechanism according to claim 1, wherein the force limiter comprises a lost motion means and the operating means is movable from a closed position to an open position, whereby movement of the operating means from the closed position to the open position moves the locking member to the non-locking state if the lock is not engaged with the locking member, and at least some of the movement of the operating means from the closed position to the open position is absorbed by the lost motion means if the lock is engaged with the locking member.

3. The locking mechanism as claimed in claim 2, further including a stop which prevents the operating means moving beyond the open position.

4. A locking mechanism as claimed in claim 1, wherein the operating means comprises a handle movable between a first position and a second position so that the locking member is in the locking state and non-locking state, respectively, when the lock is not engaged with the locking member, and wherein the connecting means comprises a gear movable by movement of the handle and is engaged with a rack, the rack being coupled to the locking member by the force limiter.

5. A locking mechanism as claimed in claim 1, in which the force limiter is a spring.

6. A locking mechanism as claimed in claim 1, wherein the lock comprises one or more of an electric release and/or a mortice lock.

7. A locking mechanism as claimed in claim 1, further including latch means biased into a restraining position in which the operating means is prevented from moving the locking member from the locking state.

8. A locking mechanism as claimed in claim 7, wherein said latch means includes a stop that prevents the movement of the locking member beyond the non-locking state.

9. A locking mechanism as claimed in claim 7, wherein said latch means is movable from the restraining position on disengagement of a hidden catch.

10. A locking mechanism as claimed in claim 1, including a lock-in prevention latch releasably engaging the locking member to prevent movement from said non-locking state.

11. A locking mechanism as claimed in claim 10, wherein the lock-in prevention latch is only released from engagement with the locking member from inside a door to which the locking mechanism is fitted onto.

12. A door assembly including a locking mechanism as claimed in claim 1.

* * * * *